US008130118B2

(12) United States Patent
Hall et al.

(10) Patent No.: US 8,130,118 B2
(45) Date of Patent: Mar. 6, 2012

(54) WIRED TOOL STRING COMPONENT

(75) Inventors: David R Hall, Provo, UT (US); Scott Dahlgren, Alpine, UT (US); Paul Schramm, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 63 days.

(21) Appl. No.: 12/432,231

(22) Filed: Apr. 29, 2009

(65) Prior Publication Data

US 2009/0212970 A1 Aug. 27, 2009

Related U.S. Application Data

(63) Continuation of application No. 11/421,387, filed on May 31, 2006, now Pat. No. 7,535,377, which is a continuation-in-part of application No. 11/421,357, filed on May 31, 2006, now Pat. No. 7,382,273, which is a continuation-in-part of application No. 11/133,905, filed on May 21, 2005, now Pat. No. 7,277,026.

(51) Int. Cl.
*G01V 3/00* (2006.01)

(52) U.S. Cl. ..... 340/853.7; 340/854.8; 340/854.9; 340/855.1; 340/855.2; 166/297

(58) Field of Classification Search ..... 340/853.7, 340/854.8, 854.9, 855.1, 855.2; 166/297
See application file for complete search history.

(56) References Cited

U.S. PATENT DOCUMENTS

| | | | |
|---|---|---|---|
| 1,971,315 | A | 8/1934 | Lear |
| 2,000,716 | A | 5/1935 | Polk |
| 2,064,771 | A | 12/1936 | Vogt |
| 2,301,783 | A | 11/1942 | Lee |
| 2,331,101 | A | 10/1943 | Beard |
| 2,414,719 | A | 1/1947 | Cloud |
| 2,748,358 | A | 9/1956 | Johnston |
| 3,090,031 | A | 5/1963 | Lord |
| 3,170,137 | A | 2/1965 | Brandt |
| 3,253,245 | A | 5/1966 | Brandt |
| 3,742,444 | A | 6/1973 | Lindsey |
| 3,876,972 | A | 4/1975 | Garrett |
| 3,967,201 | A | 6/1976 | Rorden |
| 3,980,881 | A | 9/1976 | Veach et al. |
| 4,012,092 | A | 3/1977 | Godbey |
| 4,039,237 | A | 8/1977 | Cullen |
| 4,042,874 | A | 8/1977 | Quinn et al. |
| 4,095,865 | A | 6/1978 | Denison et al. |

(Continued)

OTHER PUBLICATIONS

U.S. Appl. No. 11/133,905, filed May 21, 2005, Hall.

(Continued)

*Primary Examiner* — Brian Zimmerman
*Assistant Examiner* — Amine Benlagsir
(74) *Attorney, Agent, or Firm* — Brinks Hofer Gilson & Lione

(57) ABSTRACT

A system is disclosed as having first and second tubular tool string components. Each component has a first end and a second end, and the first end of the first component is coupled to the second end of the second component through mating threads. First and second inductive coils are disposed within the first end of the first component and the second end of the second component, respectively. Each inductive coil has at least one turn of an electrical conductor, and the first coil is in magnetic communication with the second coil. The first coil has more turns than the second coil.

16 Claims, 20 Drawing Sheets

U.S. PATENT DOCUMENTS

| | | | | |
|---|---|---|---|---|
| 4,176,894 | A | 12/1979 | Godbey | |
| 4,416,494 | A | 11/1983 | Watkins | |
| 4,578,675 | A * | 3/1986 | MacLeod | 340/853.7 |
| 4,591,226 | A | 5/1986 | Hargett et al. | |
| 4,660,910 | A | 4/1987 | Sharp | |
| 4,785,247 | A | 11/1988 | Meador | |
| 4,788,544 | A | 11/1988 | Howard | |
| 4,806,928 | A | 2/1989 | Vereruso | |
| 4,884,071 | A | 11/1989 | Howard | |
| 4,901,069 | A | 2/1990 | Veneruso | |
| 4,953,136 | A | 8/1990 | Kamata et al. | |
| 5,008,664 | A | 4/1991 | More et al. | |
| 5,336,997 | A | 8/1994 | Anim-Appiah et al. | |
| 5,337,002 | A | 8/1994 | Mercer | |
| 5,385,476 | A | 1/1995 | Jasper | |
| 5,744,877 | A | 4/1998 | Owens | |
| 5,928,546 | A | 7/1999 | Kramer et al. | |
| 6,123,561 | A | 9/2000 | Turner et al. | |
| 6,223,826 | B1 | 5/2001 | Chau | |
| 6,367,564 | B1 | 4/2002 | Mills | |
| 6,392,317 | B1 | 5/2002 | Hall | |
| 6,402,524 | B2 | 6/2002 | Wurm | |
| 6,446,728 | B2 | 9/2002 | Chau | |
| 6,651,755 | B1 | 11/2003 | Kelpe | |
| 6,655,464 | B2 | 12/2003 | Chau | |
| 6,670,880 | B1 | 12/2003 | Hall | |
| 6,684,952 | B2 | 2/2004 | Brockman et al. | |
| 6,688,396 | B2 | 2/2004 | Floerke et al. | |
| 6,717,501 | B2 | 4/2004 | Hall | |
| 6,727,827 | B1 * | 4/2004 | Edwards et al. | 340/854.9 |
| 6,739,413 | B2 | 5/2004 | Sharp | |
| 6,799,632 | B2 | 10/2004 | Hall | |
| 6,821,147 | B1 | 11/2004 | Hall | |
| 6,830,467 | B2 | 12/2004 | Hall | |
| 6,831,571 | B2 | 12/2004 | Bartel | |
| 6,844,498 | B2 | 1/2005 | Hall | |
| 6,845,822 | B2 | 1/2005 | Chau | |
| 6,888,473 | B1 | 5/2005 | Hall | |
| 6,913,093 | B2 | 7/2005 | Hall | |
| 6,929,493 | B2 | 8/2005 | Hall | |
| 6,945,802 | B2 | 9/2005 | Hall | |
| 6,968,611 | B2 | 11/2005 | Hall | |
| 6,981,546 | B2 | 1/2006 | Hall et al. | |
| 6,982,384 | B2 | 1/2006 | Hall et al. | |
| 6,991,035 | B2 | 1/2006 | Hall et al. | |
| 6,992,554 | B2 | 1/2006 | Hall et al. | |
| 7,002,445 | B2 | 2/2006 | Hall et al. | |
| 7,017,667 | B2 | 3/2006 | Hall et al. | |
| 7,019,665 | B2 | 3/2006 | Hall et al. | |
| 7,028,779 | B2 | 4/2006 | Chau | |
| 7,040,003 | B2 | 5/2006 | Hall et al. | |
| 7,041,908 | B2 | 5/2006 | Hall et al. | |
| 7,053,788 | B2 | 5/2006 | Hall et al. | |
| 7,064,676 | B2 | 6/2006 | Hall et al. | |
| 7,069,999 | B2 | 7/2006 | Hall et al. | |
| 7,080,998 | B2 | 7/2006 | Hall et al. | |
| 7,091,810 | B2 | 8/2006 | Hall et al. | |
| 7,098,767 | B2 | 8/2006 | Hall et al. | |
| 7,098,802 | B2 | 8/2006 | Hall et al. | |
| 7,123,160 | B2 | 10/2006 | Hall et al. | |
| 7,139,218 | B2 | 11/2006 | Hall et al. | |
| 7,142,129 | B2 | 11/2006 | Hall et al. | |
| 7,150,329 | B2 | 12/2006 | Chau | |
| 7,165,618 | B2 | 1/2007 | Brockman et al. | |
| 7,168,510 | B2 | 1/2007 | Boyle et al. | |
| 7,170,424 | B2 | 1/2007 | Vinegar et al. | |
| 7,190,280 | B2 | 3/2007 | Hall et al. | |
| 7,193,526 | B2 | 3/2007 | Hall et al. | |
| 7,193,527 | B2 | 3/2007 | Hall et al. | |
| 7,198,118 | B2 | 4/2007 | Hall et al. | |
| 7,201,240 | B2 | 4/2007 | Hall et al. | |
| 7,224,288 | B2 | 5/2007 | Hall et al. | |
| 7,243,717 | B2 | 7/2007 | Hall et al. | |
| 7,253,745 | B2 | 8/2007 | Hall et al. | |
| 7,259,689 | B2 | 8/2007 | Hernandez-Marti et al. | |
| 7,261,154 | B2 | 8/2007 | Hall et al. | |
| 7,277,025 | B2 * | 10/2007 | Allan | 340/854.8 |
| 7,298,286 | B2 | 11/2007 | Hall | |
| 7,362,235 | B1 * | 4/2008 | Normann et al. | 340/854.8 |
| 7,382,273 | B2 * | 6/2008 | Hall et al. | 340/854.8 |
| 7,453,768 | B2 * | 11/2008 | Hall et al. | 367/82 |
| 7,482,945 | B2 | 1/2009 | Hall | |
| 7,488,194 | B2 | 2/2009 | Hall et al. | |
| 7,504,963 | B2 | 3/2009 | Hall et al. | |
| 7,535,377 | B2 * | 5/2009 | Hall et al. | 340/854.8 |
| 7,537,053 | B1 | 5/2009 | Hall et al. | |
| 7,566,235 | B2 | 7/2009 | Bottos et al. | |
| 7,572,134 | B2 | 8/2009 | Hall et al. | |
| 7,586,934 | B2 | 9/2009 | Hall et al. | |
| 7,649,475 | B2 | 1/2010 | Hall et al. | |
| 7,817,062 | B1 | 10/2010 | Li et al. | |
| 7,931,054 | B2 | 4/2011 | Pozgay et al. | |
| 2001/0029780 | A1 | 10/2001 | Bartel | |
| 2001/0040379 | A1 | 11/2001 | Schultz et al. | |
| 2002/0050829 | A1 | 5/2002 | Xu | |
| 2002/0135179 | A1 | 9/2002 | Boyle et al. | |
| 2002/0193004 | A1 | 12/2002 | Boyle et al. | |
| 2003/0094282 | A1 | 5/2003 | Goode et al. | |
| 2004/0020644 | A1 | 2/2004 | Wilson et al. | |
| 2004/0104797 | A1 | 6/2004 | Hall | |
| 2004/0108108 | A1 | 6/2004 | Bailey et al. | |
| 2004/0113808 | A1 | 6/2004 | Hall | |
| 2004/0118608 | A1 | 6/2004 | Haci et al. | |
| 2004/0140128 | A1 | 7/2004 | Vail | |
| 2004/0145482 | A1 | 7/2004 | Anderson | |
| 2004/0145492 | A1 | 7/2004 | Hall | |
| 2004/0150532 | A1 | 8/2004 | Hall | |
| 2004/0164636 | A1 | 8/2004 | Okamoto et al. | |
| 2004/0164833 | A1 | 8/2004 | Hall | |
| 2004/0164838 | A1 | 8/2004 | Hall | |
| 2004/0202047 | A1 * | 10/2004 | Fripp et al. | 367/81 |
| 2004/0216847 | A1 | 11/2004 | Hall | |
| 2004/0217880 | A1 * | 11/2004 | Clark et al. | 340/854.9 |
| 2004/0244816 | A1 | 12/2004 | Luo | |
| 2004/0244916 | A1 | 12/2004 | Hall | |
| 2004/0244964 | A1 | 12/2004 | Hall | |
| 2004/0246142 | A1 | 12/2004 | Hall | |
| 2005/0001730 | A1 | 1/2005 | Alderman | |
| 2005/0001735 | A1 | 1/2005 | Hall | |
| 2005/0001736 | A1 | 1/2005 | Hall | |
| 2005/0001738 | A1 | 1/2005 | Hall | |
| 2005/0035874 | A1 | 2/2005 | Hall | |
| 2005/0035875 | A1 | 2/2005 | Hall | |
| 2005/0035876 | A1 | 2/2005 | Hall | |
| 2005/0036507 | A1 | 2/2005 | Hall | |
| 2005/0039912 | A1 | 2/2005 | Hall | |
| 2005/0045339 | A1 | 3/2005 | Hall | |
| 2005/0046586 | A1 | 3/2005 | Hall | |
| 2005/0046590 | A1 | 3/2005 | Hall | |
| 2005/0067159 | A1 | 3/2005 | Hall | |
| 2005/0070144 | A1 | 3/2005 | Hall | |
| 2005/0082082 | A1 | 4/2005 | Walter et al. | |
| 2005/0082092 | A1 | 4/2005 | Hall | |
| 2005/0092499 | A1 | 5/2005 | Hall | |
| 2005/0093296 | A1 | 5/2005 | Hall | |
| 2005/0095827 | A1 | 5/2005 | Hall | |
| 2005/0115717 | A1 | 6/2005 | Hall | |
| 2005/0145406 | A1 | 7/2005 | Hall | |
| 2005/0150653 | A1 | 7/2005 | Hall | |
| 2005/0150853 | A1 | 7/2005 | Kimball | |
| 2005/0161215 | A1 | 7/2005 | Hall | |
| 2005/0173128 | A1 | 8/2005 | Hall | |
| 2005/0190584 | A1 | 9/2005 | Hernandez-Marti et al. | |
| 2005/0212530 | A1 | 9/2005 | Hall | |
| 2005/0236160 | A1 | 10/2005 | Hall | |
| 2005/0284662 | A1 | 12/2005 | Hall | |
| 2005/0285705 | A1 * | 12/2005 | Hall et al. | 336/132 |
| 2006/0038699 | A1 | 2/2006 | Dodge et al. | |
| 2006/0048586 | A1 | 3/2006 | Sanada et al. | |
| 2006/0113803 | A1 | 6/2006 | Hall et al. | |
| 2006/0124291 | A1 | 6/2006 | Chau | |
| 2006/0126249 | A1 | 6/2006 | Boling | |
| 2006/0129339 | A1 | 6/2006 | Bruno | |
| 2006/0187084 | A1 | 8/2006 | Hernandez-Marti et al. | |
| 2006/0236160 | A1 | 10/2006 | Ueda et al. | |

| | | | | |
|---|---|---|---|---|
| 2007/0017671 | A1 | 1/2007 | Clark et al. | |
| 2007/0018848 | A1* | 1/2007 | Bottos et al. | 340/854.4 |
| 2007/0030167 | A1* | 2/2007 | Li et al. | 340/855.1 |
| 2007/0102197 | A1 | 5/2007 | Rotthaeuser | |
| 2007/0137853 | A1 | 6/2007 | Zhang et al. | |
| 2008/0041575 | A1 | 2/2008 | Clark et al. | |
| 2008/0047703 | A1 | 2/2008 | Stoesz et al. | |
| 2009/0151926 | A1 | 6/2009 | Hall et al. | |
| 2009/0151932 | A1 | 6/2009 | Hall et al. | |
| 2009/0212970 | A1 | 8/2009 | Hall et al. | |

OTHER PUBLICATIONS

Emmerich, Claude L., "Steady-State Internal Temperature Rise in Magnet Coil Windings," 21 *Journal of Applied Physics* 75-80 (Feb. 1950).

Hughes, Edward, "Determination of the Final Temperature-Rise of Electrical Machines from Heating Tests of Short Duration," 68(403) *Journal of the Institution of Electrical Engineers* 932-941 (Jul. 1930).

* cited by examiner

WIRED TOOL STRING COMPONENT

CROSS REFERENCE TO RELATED APPLICATIONS

This application is a continuation of U.S. patent application Ser. No. 11/421,387 filed on May 31, 2006 and now U.S. Pat. No. 7,535,377, which is a continuation-in-part of U.S. patent application Ser. No. 11/421,357 filed on May 31, 2006 and now U.S. Pat. No. 7,382,273, which is a continuation-in-part of U.S. patent application Ser. No. 11/133,905 filed on May 21, 2006 and now U.S. Pat. No. 7,277,026.

All of these applications are herein incorporated by reference in their entirety.

BACKGROUND OF THE INVENTION

As downhole instrumentation and tools have become increasingly more complex in their composition and versatile in their functionality, the need to transmit power and/or data through tubular tool string components is becoming ever more significant. Real-time logging tools located at a drill bit and/or throughout a tool string require power to operate. Providing power downhole is challenging, but if accomplished it may greatly increase the efficiency of drilling. Data collected by logging tools are is even more valuable when it is received at the surface in real time.

The goal of transmitting power or data through downhole tool string components is not new. Throughout recent decades, many attempts have been made to provide high-speed data transfer or usable power transmission through tool string components. One technology developed involves using inductive couplers to transmit an electric signal across a tool joint. U.S. Pat. No. 2,414,719 to Cloud discloses an inductive coupler positioned within a downhole pipe to transmit a signal to an adjacent pipe.

U.S. Pat. No. 4,785,247 to Meador discloses an apparatus and method for measuring formation parameters by transmitting and receiving electromagnetic signals by antennas disposed in recesses in a tubular housing member and includes an apparatus for reducing the coupling of electrical noise into the system resulting from conducting elements located adjacent the recesses and housing.

U.S. Pat. No. 4,806,928 to Veneruso describes a downhole tool adapted to be coupled in a pipe string and positioned in a well. The downhole tool is provided with one or more electrical devices cooperatively arranged to receive power from surface power sources or to transmit and/or receive control or data signals from surface equipment. Inner and outer coil assemblies arranged on ferrite cores are arranged on the downhole tool and a suspension cable for electromagnetically coupling the electrical devices to the surface equipment is provided.

U.S. Pat. No. 6,670,880 to Hall also discloses the use of inductive couplers in tool joints to transmit data or power through a tool string. The '880 patent teaches the inductive couplers lying in magnetically insulating, electrically conducting troughs. The troughs conduct magnetic flux while preventing resultant eddy currents. U.S. Pat. No. 6,670,880 is herein incorporated by reference for all that it discloses.

U.S. patent application Ser. No. 11/133,905, also to Hall, discloses a tubular component in a downhole tool string with first and second inductive couplers in a first end and third and fourth inductive couplers in a second end. A first conductive medium connects the first and third couplers and a second conductive medium connects the second and fourth couplers. The first and third couplers are independent of the second and fourth couplers. Application Ser. No. 11/133,905 is herein incorporated by reference for all that it discloses.

BRIEF SUMMARY OF THE INVENTION

In one aspect of the invention, a system comprises first and second tubular tool string components. The components are preferably selected from the group consisting of drill pipes, production pipes, drill collars, heavyweight pipes, reamers, bottom-hole assembly components, jars, hammers, swivels, drill bits, sensors, and subs. Each component has a first end and a second end. The first end of the first component is coupled to the second end of the second component through mating threads.

First and second inductive coils are disposed within the first end of the first component and the second end of the second component, respectively. Each coil has at least one turn of an electrical conductor. The first coil is in magnetic communication with the second coil, and the first coil has more turns than the second coil. The inductive coils may, in some embodiments, be lying in magnetically conductive troughs. In some embodiments the troughs may be magnetically conductive and electrically insulating.

In some embodiments of the invention, a downhole power source such as a generator, battery, or additional tubular tool string component may be in electrical communication with at least one of the inductive coils. The system may even be adapted to alter voltage from an electrical current such as a power or data signal transmitted from the first component to the second component through the inductive coils.

In another aspect of the invention, an apparatus includes a tubular tool string component having a first end and a second end. First and second magnetically conductive, electrically insulating are disposed within the first and second ends of the downhole component, respectively. Preferably, the troughs are disposed within shoulders of the downhole components.

Each trough has an electrical coil having at least one turn lying therein, and the electrical coil of the first trough has more turns than the electrical coil of the second trough. An electrical conductor has a first end in electrical communication with the electrical coil of the first trough and a second end in electrical communication with the electrical coil of the second trough. The electrical conductor may be a coaxial cable, a twisted pair of wires, a copper wire, a triaxial cable, a combination thereof. In some embodiments the apparatus is tuned to pass an electrical signal from one electrical coil through the electrical conductor to the other electrical coil at a resonant frequency.

According to another aspect of the invention, a method includes the steps of providing a data transmission system, generating downhole an electric current having a voltage, transmitting the electric current to a downhole tool through the data transmission system, and altering the voltage of the electric current through an unequal turn ration in at least one pair of inductive couplers. The data transmission system comprises a plurality of wired drill pipe interconnected through inductive couplers, each inductive coupler having at least one turn of an electrical conductor.

The electric current in some embodiments may be generated by a battery or a downhole generator. The downhole tool may be a part of a bottom hole assembly. In some embodiments the step of altering the voltage of the electric current includes stepping the voltage down to a voltage required by the tool. Additionally, in some embodiments the electric current may be transmitted to a plurality of downhole tools.

DETAILED DESCRIPTION

Figure 1:
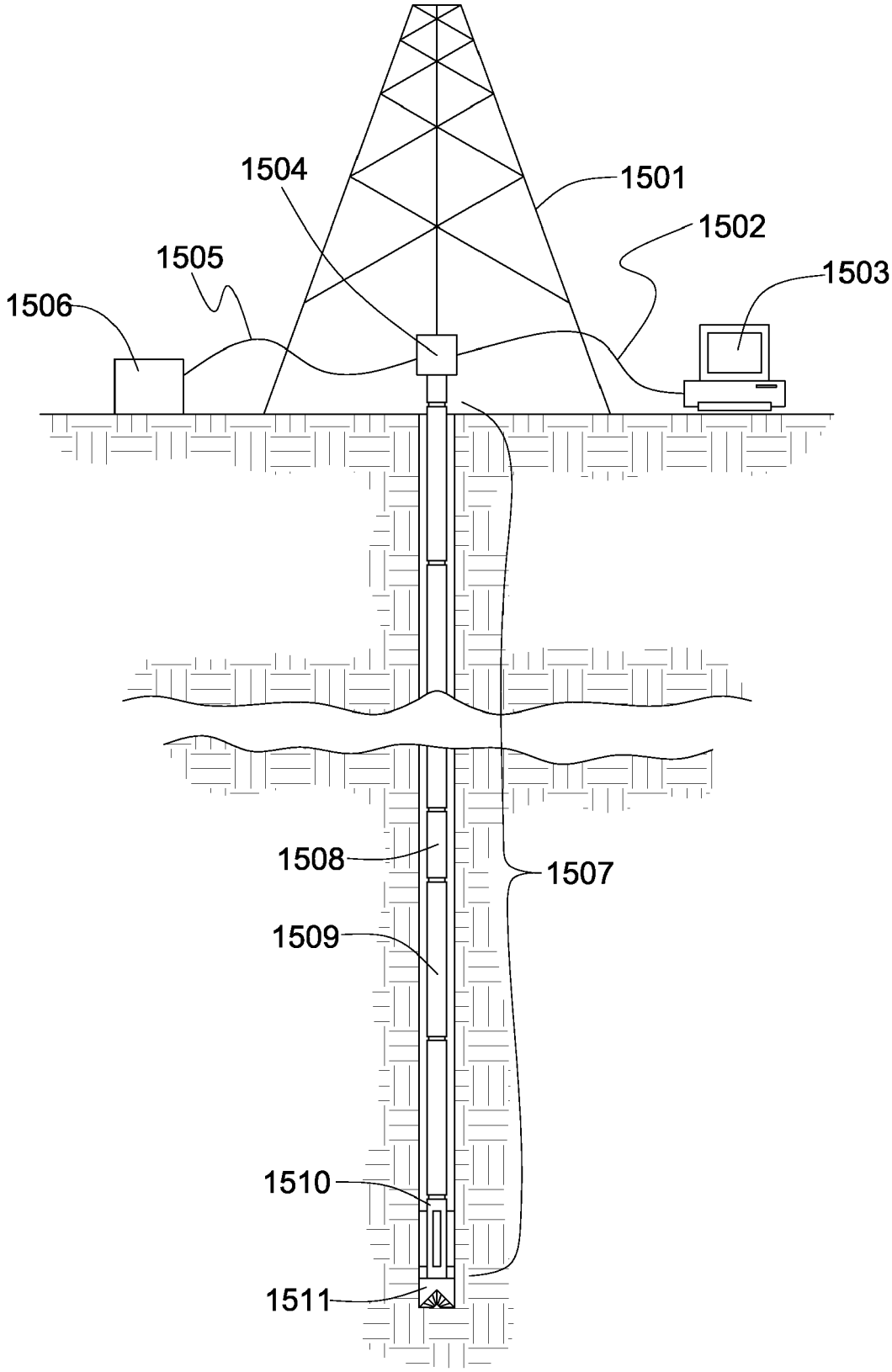
FIG. 1 is a cross-sectional view of of a drill site.

FIG. 1 is a cross-sectional view of a drill rig 1501 and a downhole tool string 1507 which may incorporate embodiments of the present invention. The downhole tool string 1507 comprises a drill bit 1511, a bottom-hole assembly 1510, drill pipe 1509, a sub 1508, and a swivel 1504. Preferably, the downhole tool string 1507 further comprises a two-way telemetry system for data and/or power transmission. The swivel 1504 may be connected via cables 1502, 1505 to surface equipment such as a computer 1503 or a generator 1506. The swivel 1504 may be an interface for data transfer from the rotating tool string 1507 to the stationary surface equipment. In some embodiments, the generator 1506 may provide power to the tool string 1507, including the downhole components such as the sub 1508, the drill pipe 1509, and the bottom-hole assembly 1510. In some embodiments, the power may also be stored or generated downhole.

Figure 2:
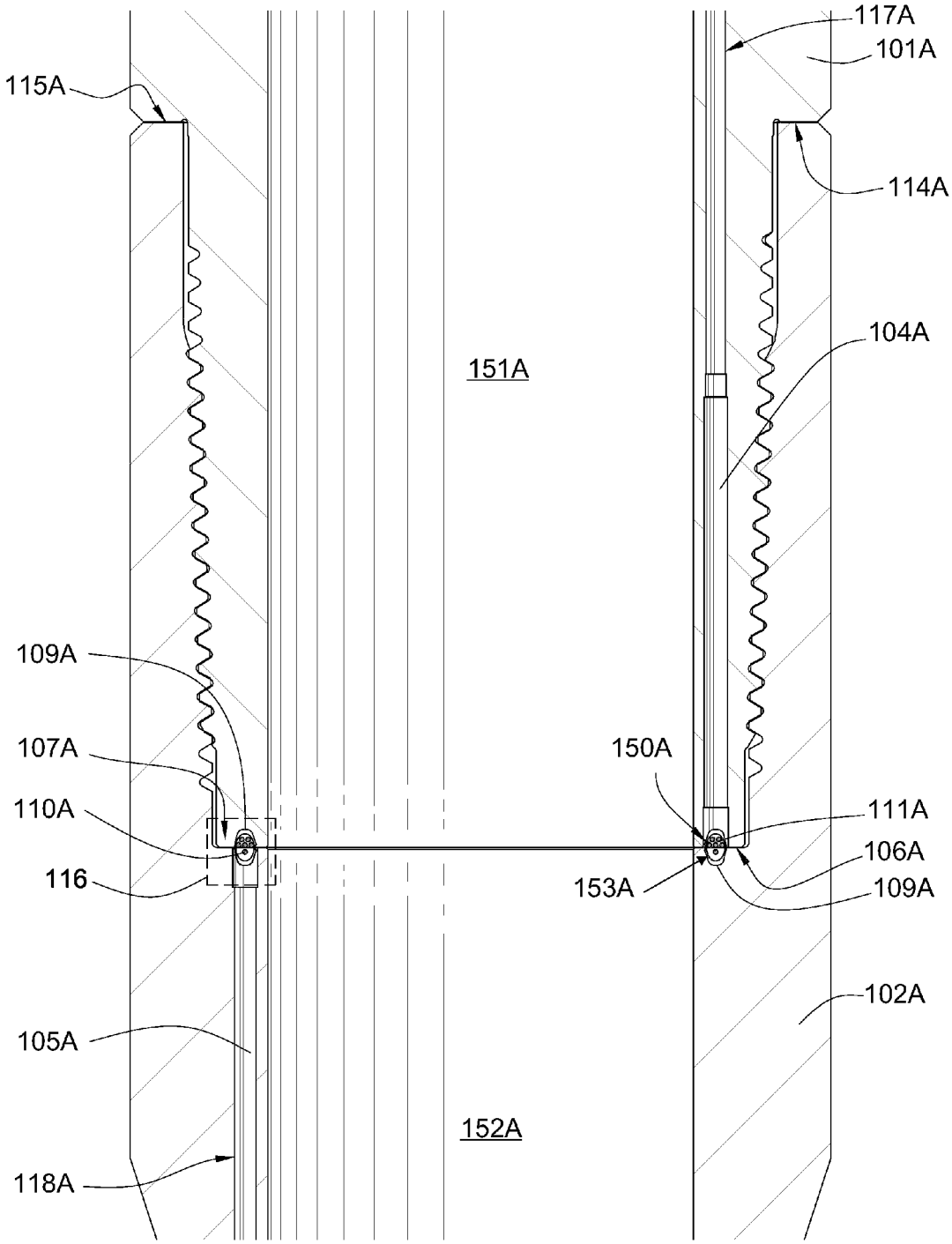
FIG. 2 is a cross-sectional view diagram of an embodiment showing a first tool and a second tool threadedly connected.

FIG. 2 shows a telemetry system for transmitting an electrical signal between a first wired tubular tool string component 101A threadably connected to a second wired tubular tool string component 102A. Each wired tubular string component 101A, 102A may have at least one signal coupler 150A, 153A disposed within grooves 109A formed in its secondary shoulders 107A, 106A. The signal couplers 150A, 153A may be inductive couplers comprising having electrically conductive coils 111A, 110A. The signal couplers 150A, 153A may be in electrical communication with electrical conductors 104A, 105A.

The tool string components 101A, 102A may be selected from the group consisting of drill pipe, production pipe, drill collars, heavy weight pipe, reamers, bottom-hole assembly components, tool string components, jars, hammers, swivels, drill bits, sensors, and subs.

The tool string components 101A, 102A may have at least two shoulders, including primary shoulders, such as first shoulder 115A, and second shoulder 114A, and secondary shoulders such as third shoulder 107A, and fourth shoulder 106A. The primary shoulders, first shoulder 115A, second shoulder 114A, support the majority of the make-up torque and also the load of the tool string. The secondary shoulders, third shoulder 107A, fourth shoulder 106A, are located internally with respect to the primary shoulder, first shoulder 115A, second shoulder 114A and are designed to support any overloads experienced by the tool joints. There may be gun-drilled holes 117A, 118A extending from the grooves 109A to the bores 151A, 152A of the tool string components 101A, 102A. At least a portion of electrical conductors 104A, 105A may be secured within the holes 117A, 118A. This may be accomplished by providing the holes 117A, 118A with at least two diameters such that the narrower diameter of each hole 117A, 118A grips a wider portion of the electrical conductors 104A, 105A. The electrical conductors 104A, 105A may be selected from the group consisting of coaxial cables, shielded coaxial cables, twisted pairs of wire, triaxial cables, and biaxial cables.

Figure 3:
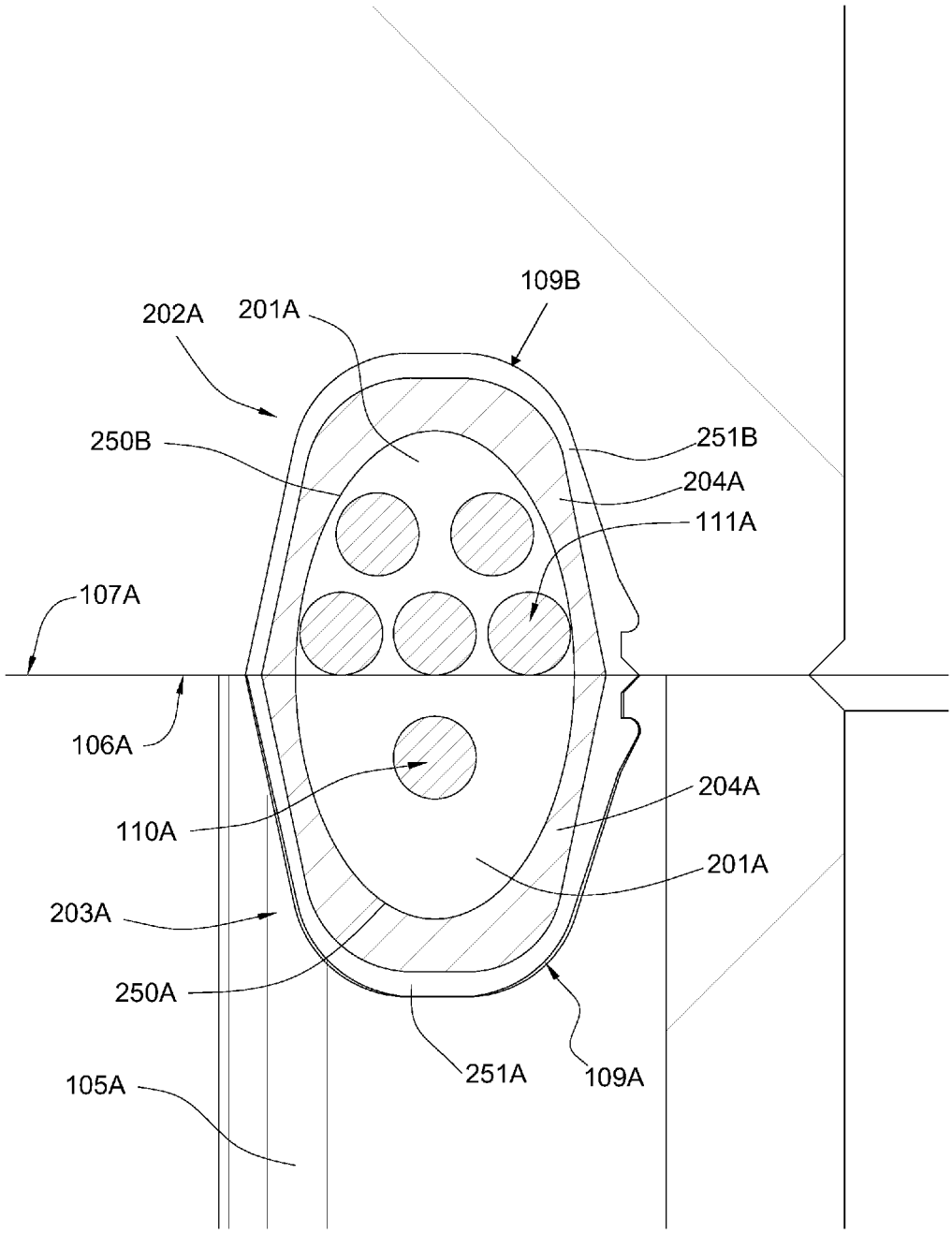
FIG. 3 is a close up view of an inductive coupler of FIG. 2.

FIG. 3 is a close up view 116 of the data couplers 150A, 153A of FIG. 2. In this embodiment, first and second inductive couplers 202A, 203A may be disposed within the grooves 109A, 109B in the third shoulder 107A and second shoulder 106A. Preferably, grooves 109A, 109B have a magnetically conductive, electrically insulating (MCEI) material 204, such as ferrite, and form at least one U-shaped trough 250A, 250B. The MCEI material may also include nickel, iron, or combinations thereof. The MCEI material may be disposed within a durable ring 251A, 251B of material such as steel or stainless steel. As shown in FIG. 2, the second inductive coupler 203A is in electrical communication with the electrical conductor 105A.

Lying within the U-shaped troughs 250A, 250B formed in the MCEI material 204 are electrically conductive coils 111A, 110A. These coils 111A, 110A are preferably made from at least one turn of an insulated wire. The wire is preferably made of copper and insulated with a tough, flexible polymer such as high density polyethylene or polymerized tetraflouroethane, though other electrically conductive materials, such as silver or copper-coated steel, can be used to form the coil. The space between the coils 111A, 110A and the MCEI material 204A may be filled with an electrically insulating material 201A to protect the coils 111A, 110A. Also, the inductive couplers 202A, 203A are preferably positioned within the shoulders such that when tool string components are joined together, the MCEI material 204A in each coupler 202A, 203A contact each other for optimal signal transmission.

As shown in FIG. 3, The coils 111A, 110A are in magnetic communication with each other, allowing an electrical signal passing through one coil 111A to be reproduced in the other coil 110A through mutual inductance. As electric current flows through the first coil 111A, a magnetic field 305A in either a clockwise or counterclockwise direction is formed around the coil 111A, depending on the direction of the current through the coil 111A. This magnetic field 305A produces a current in the second coil 110A. Therefore, at least a portion of the current flowing through the first coil 111A is transmitted to the second coil 110A. Also, the amount of current transmitted from the first coil 111A to the second coil 110A can be either increased or decreased, depending on the ratio of coil turns ratio between the two coils 111A, 110A. A ratio greater than one from the first coil 111A to the second coil 110A causes a larger current in the second coil 110A, whereas a ratio less than one causes a smaller current in the second coil 110A.

In some embodiments, a signal may be transmitted in the opposite direction, from the second coil 110A to the first coil 111A. In this direction, a ratio greater than one from the first coil 111A to the second coil 110A causes a smaller current in the first coil 111A, whereas a ratio less than one causes a larger current in the first coil 111A.

In this manner a power or a data signal may be transmitted from electrical conductor 104A to the first inductive coil 111A, which may then be transmitted to the second inductive coil 110A and then to the electrical conductor 105A of the second component 102A, or from electrical conductor 105A of the second component 102A to the electrical conductor 104A of the first component 101A. The power signal may be supplied by batteries, a downhole generator, another tubular tool string component, or combinations thereof.

Figure 4:
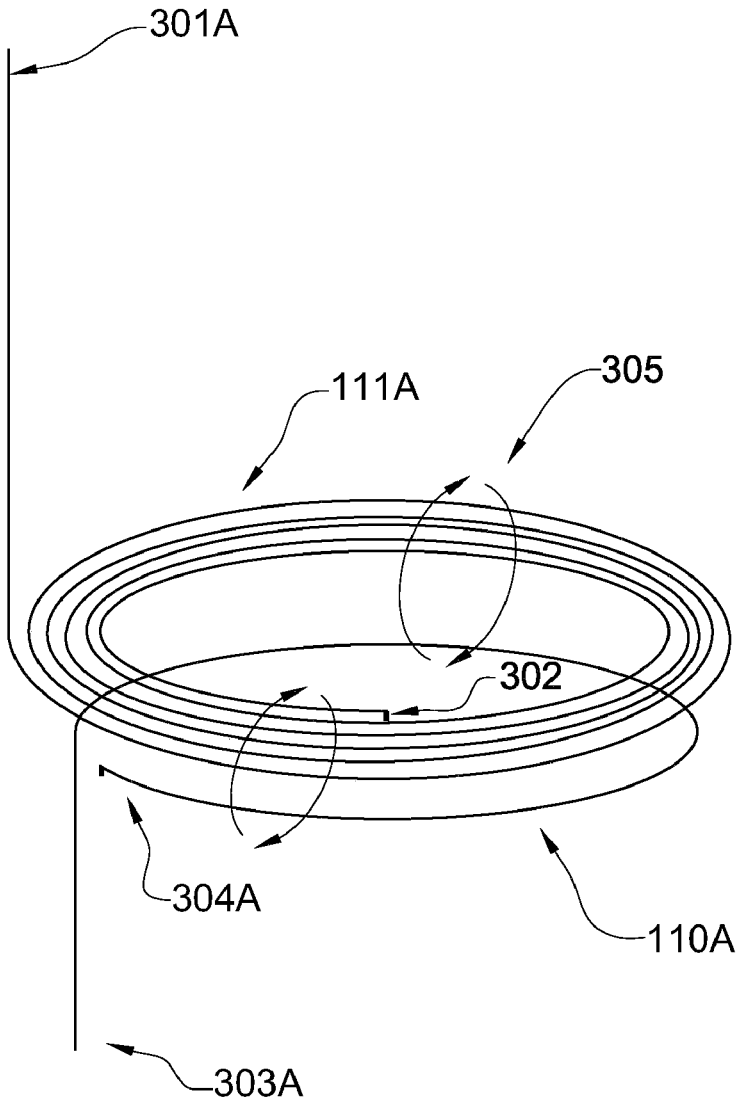
FIG. 4 is a perspective view of an embodiment of electrically conducting coils for use in an inductive coupler.

FIG. 4 is a perspective diagram of electrically conducting coils 111A, 110A. A first end 301A of the first coil 111A is connected to an electrical conductor, such as a coaxial cable, disposed within the first downhole component, such as electrical conductor 104A of the embodiment disclosed in FIG. 1. A first end 303A of the second coil 110A is connected to another electrical conductor disposed within the second downhole component, such as electrical conductor 105A disclosed in FIG. 1. The first ends 301A, 303A of the coils 110A, 111A may be inserted into the a coaxial cable such that the coils 110A, 111A and a core of the coaxial cable are in electrical communication. Second ends 302A, 304A of the first and second coils 111A, 110A may be grounded to the durable ring 251A, which is in electrical communication with the tool string component. The shield of the coaxial cable may be grounded to the downhole tool string component as well, allowing the component to be part of the electrical return path.

Figure 5:
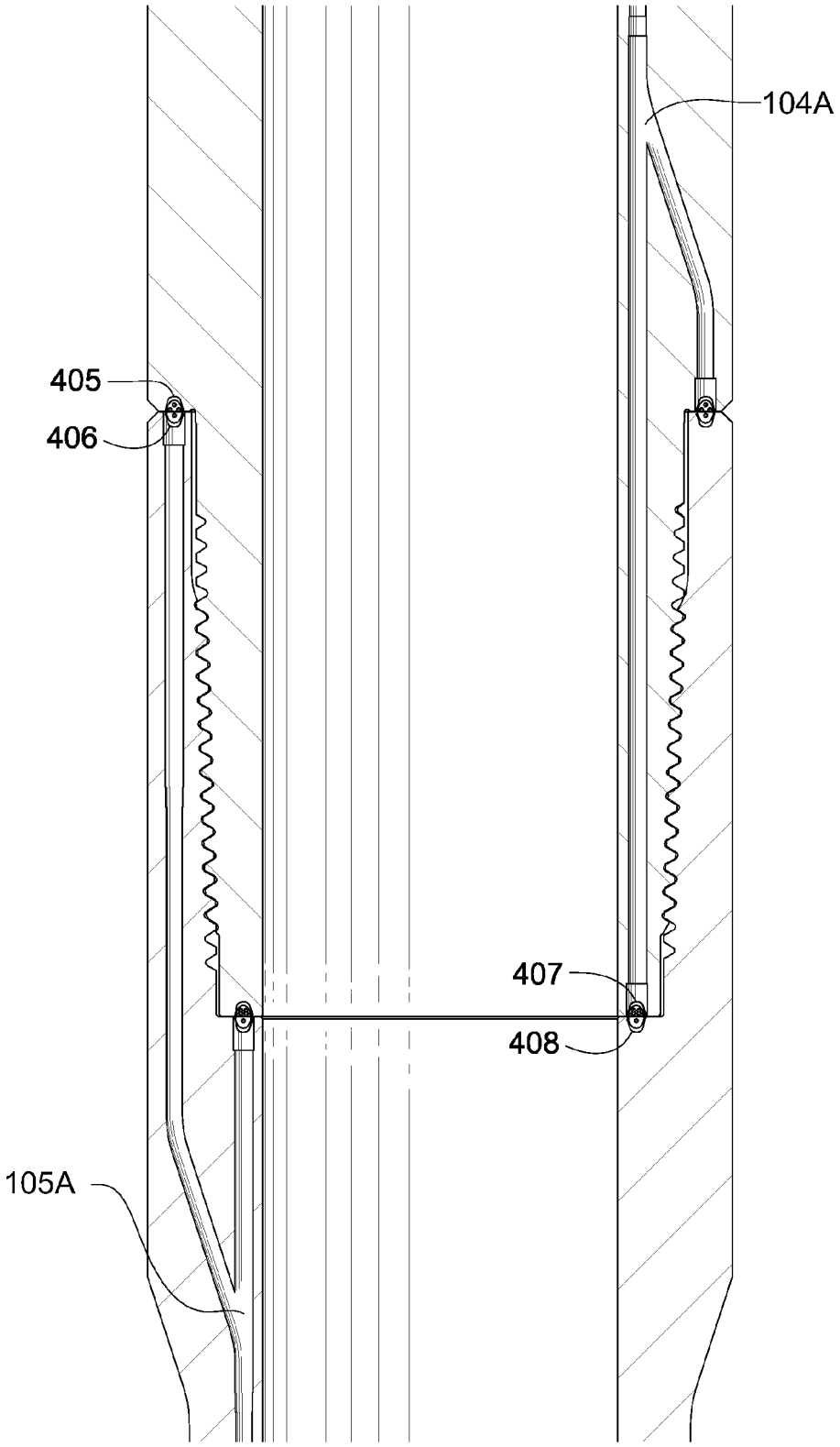
FIG. 5 is a cross sectional diagram of another embodiment showning a first tool and a second tool threadedly connected.

FIG. 5 discloses another embodiment where each of the tool string components has a single electrical conductor 104A, 105A. The ends of the electrical conductors have at least two branches which are adapted to electrically connect separate inductive couplers 405, 407, 406, 408 to the electrical conductors 104A, 105A.

The electrically conducting coils may be adapted to transmit signals at different optimal frequencies. This may be accomplished by providing the first and second coils with different geometries which may differ in number of turns, diameter, type of material, surface area, length, or combinations thereof. The first and second troughs of the couplers may also comprise different geometries as well. The inductive couplers 405, 406, 407, 408 may act as band pass filters due to their inherent inductance, capacitance and resistance such that a first frequency is allowed to pass at a first resonant frequency formed by the first and third inductive couplers 407, 408, and a second frequency is allowed to pass at a second resonant frequency formed by the second and fourth inductive couplers 405, 406.

Preferably, the signals transmitting through the electrical conductors 104A, 105A may have frequencies at or about at the resonant frequencies of the band pass filters. By configuring the signals to have different frequencies, each at one of the resonant frequencies of the couplers, the signals may be transmitted through one or more tool string components and still be distinguished from one another.

Figure 6:
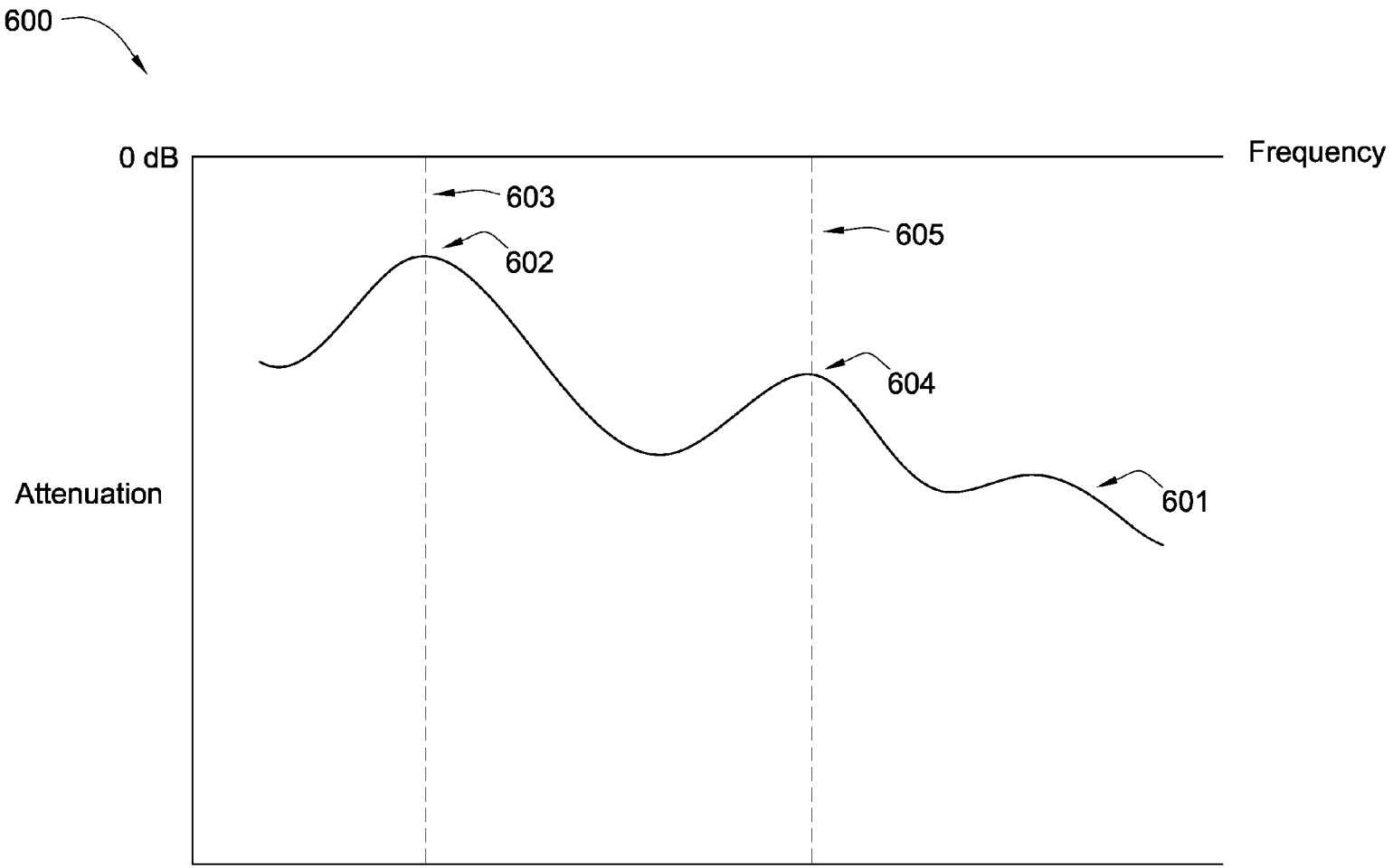
FIG. 6 is a plot of attenuation vs. frequency for a signal trace.

FIG. 6 is a plot 600 of attenuation vs. frequency for a signal trace 601 across a junction of a coupler of the current invention. The trace 601 represents a sample signal traveling through the telemetry system and shows the attenuation that the signal may have at different frequencies due to passing through filters at the inductive couplers. A first peak 602 is centered around a lower resonant frequency 603 and a second peak 604 is centered around a higher resonant frequency 605. The lower resonant frequency 603 has less attenuation and therefore produces a stronger signal and may be better for transmitting power than the higher resonant frequency 605. If a power signal is being transmitted, a band pass filter may be designed to have a resonant frequency between 500 kHz and 1 MHz for optimal power transfer.

Figure 7:
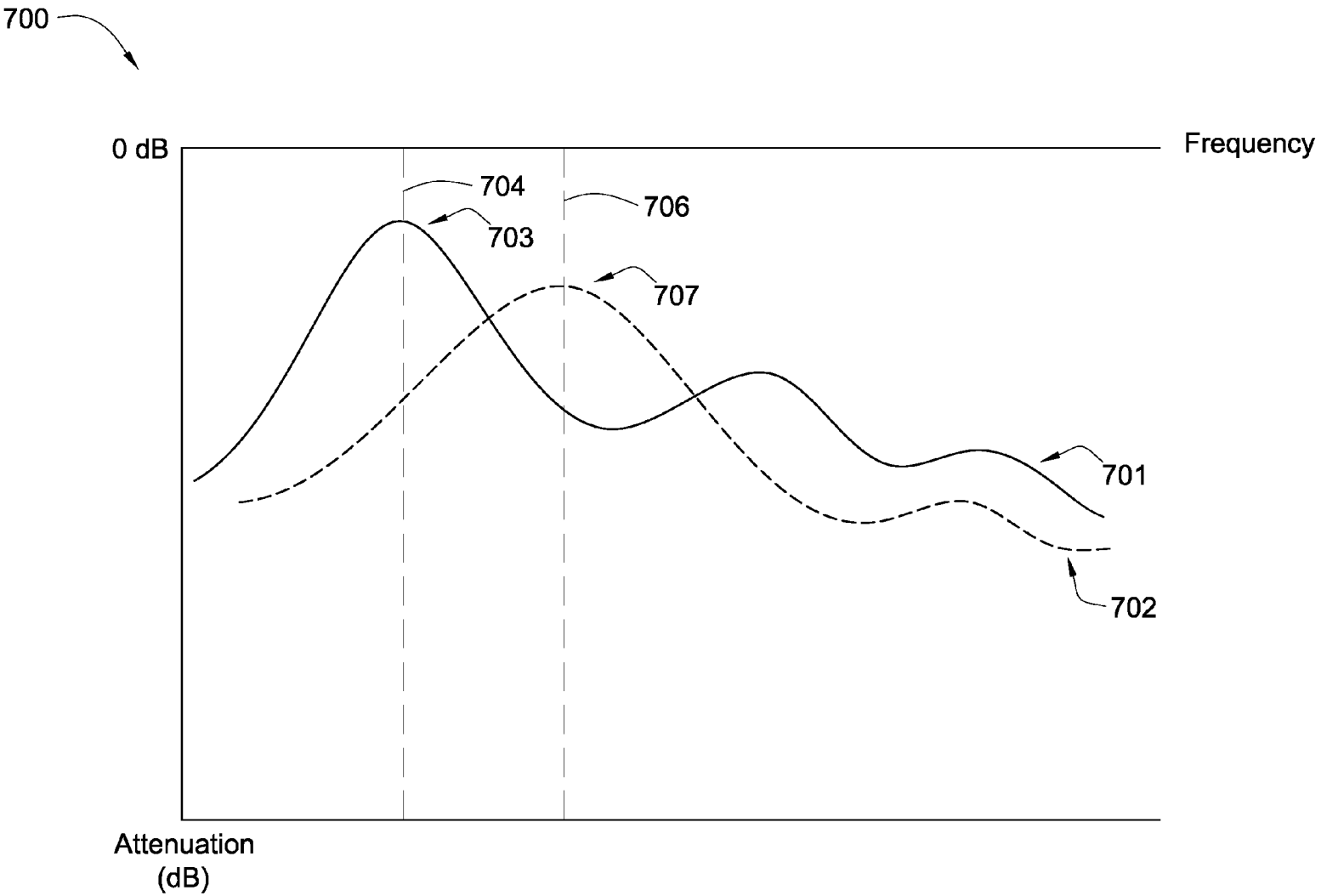
FIG. 7 is a plot of attenuation vs. frequency for two signal traces.

FIG. 7 is a sample plot 700 of two signal traces 701, 702, wherein a first signal trace 701 may be a power signal and a second signal trace 702 may be a data signal. The two signals may be transmitted on the same electrical conductor or on separate conductors. The first trace 701 has a first peak 703 centered around a first lower resonant frequency 704 and the second trace 702 has a second peak 707 centered around a second lower resonant frequency 706. Either signal may transmit power or data; however, power may best transmitted at lower frequencies, while data may be more effectively transmitted at higher frequencies.

Figure 8:
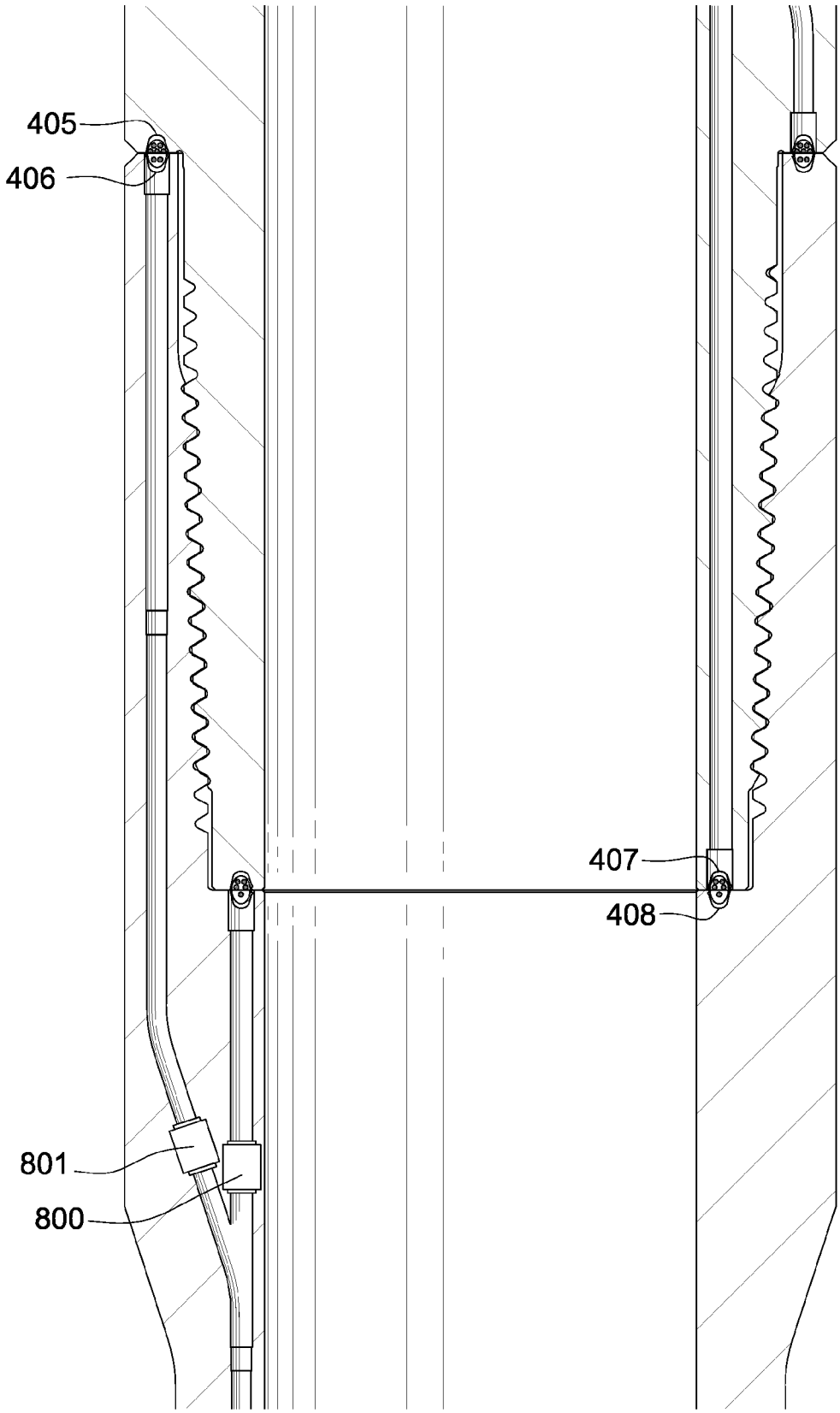
FIG. 8 is a cross-sectional view of another embodiment showing a first tool and a second tool threadedly connected.

In FIG. 5, the inherent characteristics of the inductive couplers 405, 406, 407, 408 filter the signals, whereas in the embodiment of FIG. 8 in-line band pass filters 800, 801 are disclosed. At least one of the in-line filters 800, 801 may comprise inductors, capacitors, resistors, active filters, passive filters, integrated circuit filters, crystal filters, or combinations thereof. The first in-line filter 800 may allow frequencies at or about at a first resonant frequency to pass through, while the second in-line filter 801 may allow frequencies at or about at a second resonant frequency to pass through. The in-line filters 800, 801 may be used to filter a data signal from a power signal, or any combination of power or data signals, or to fine-tune the signals to a narrower bandwidth before reaching the inductive couplers 405, 406, 407, 408.

Figure 9:
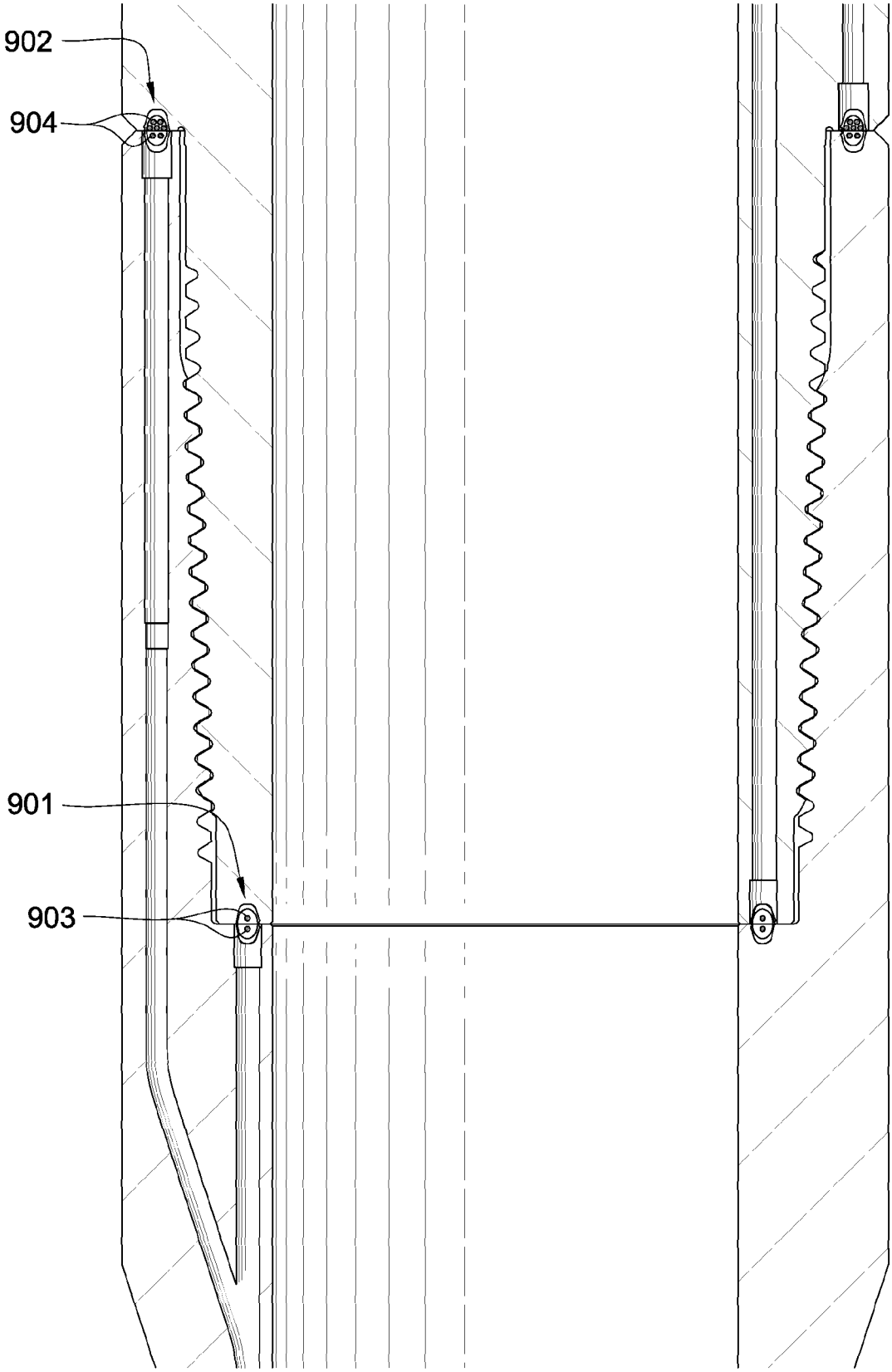
FIG. 9 is a cross-sectional view of another embodiment showing a first tool and a second tool threadedly connected.

FIG. 9 discloses another embodiment of two tool string components threadedly connected, wherein first couplers 901 are specifically designed to pass a data signal, having an equal turns ratio of one to one in coils 903, and second couplers 902 are specifically designed to pass a power signal, having an unequal turns ratio in coils 904.

Figure 10:
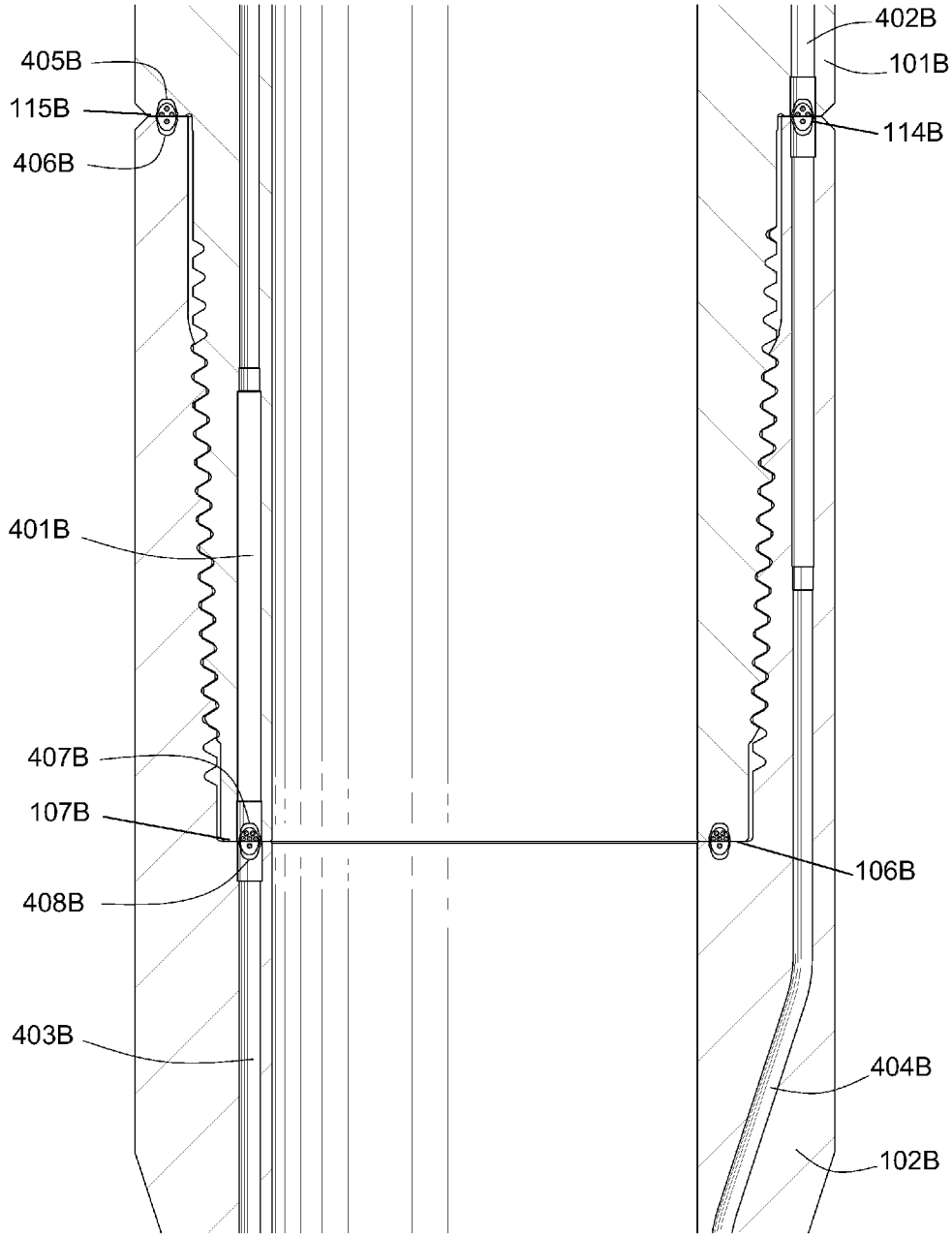
FIG. 10 is a cross-sectional view of another embodiment of a first tool and a second tool threadedly connected.

FIG. 10 discloses another embodiment of the present invention. First and second electrical conductors 401B, 402B are disposed within the first tool string component 101B and are in electrical communication with first and second inductive couplers 407B, 405B, the first coupler 407B being disposed within a groove formed in a secondary shoulder 107B and the second coupler 405B being disposed within a groove formed in a primary shoulder 115B. Similarly, the second tool string component 102B comprises third and fourth electrical conductors 403B, 404B with third and forth inductive couplers 406B, 408B adapted to communicate with the first and second couplers 407B, 405B.

An example of when it may be advantageous to have separate electrical conductors in the same tool string component is when two separate signals are being transmitted through the tool string at the same time, such as a data signal and a power signal. The signals may need to be distinguished from one another, and separate electrical conductors may accomplish this. It may also be desired by two separate parties, both desiring to transmit information and/or data through a tool string, to have separate electrical conductors to obtain higher bandwidth or higher security.

Figure 11:
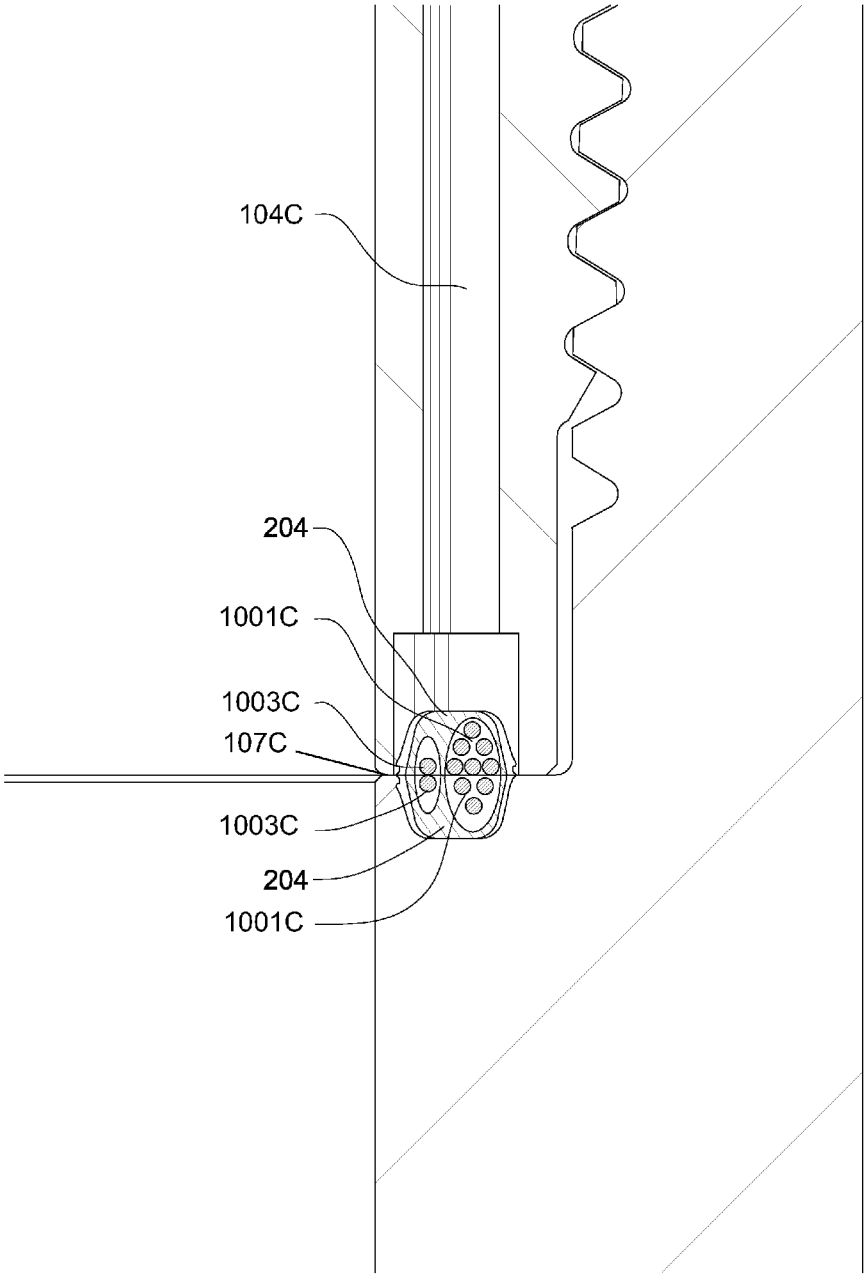
FIG. 11 is a cross-sectional view of an embodiment of a coupler having at least two troughs.

FIG. 11 is a cross-sectional diagram of an embodiment of two pairs of coils 1001C, 1003C disposed within different troughs of MCEI material 204 of the same couplers. In this configuration, the geometries of the separate pairs of coils 1001C, 1003C and troughs may be designed to have different resonant frequencies such as resonances 704, 706 as shown in FIG. 7. Two different signals having different frequencies, each at one of the resonant frequencies 704, 706 of the coils 1001C, 1003C, may then be transmitted through a single conductor 104C. This configuration may be advantageous because having a single coupler disposed within the secondary shoulder 107C of the tool string component may be simpler to manufacture.

Although this embodiment depicts one pair of coils 1003 having the same number of turns, and the other pair of coils 1001 having a different number of turns, any combination of turns and ratios may be used.

Figure 12:
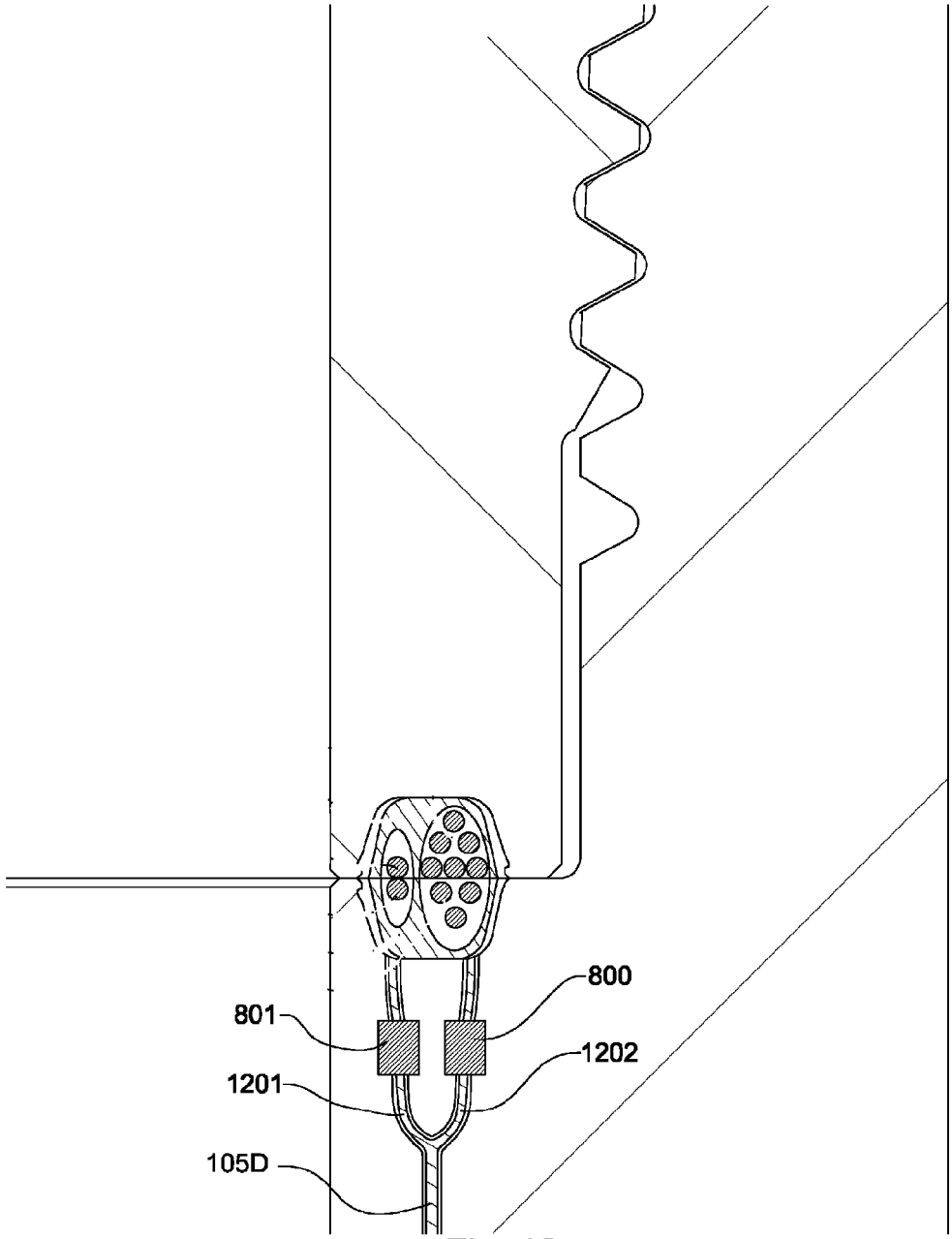
FIG. 12 is a cross-section view of another embodiment of a coupler having at least two troughs.

FIG. 12 discloses another embodiment of the present invention having in-line filters 800, 801 on branches 1201, 1202 of the electrical conductor 105D which may be used to separate a data signal from a power signal, or any combination of power and/or data signals, or to fine-tune the signals to a narrower bandwidth before reaching the inductive couplers.

Figure 13:
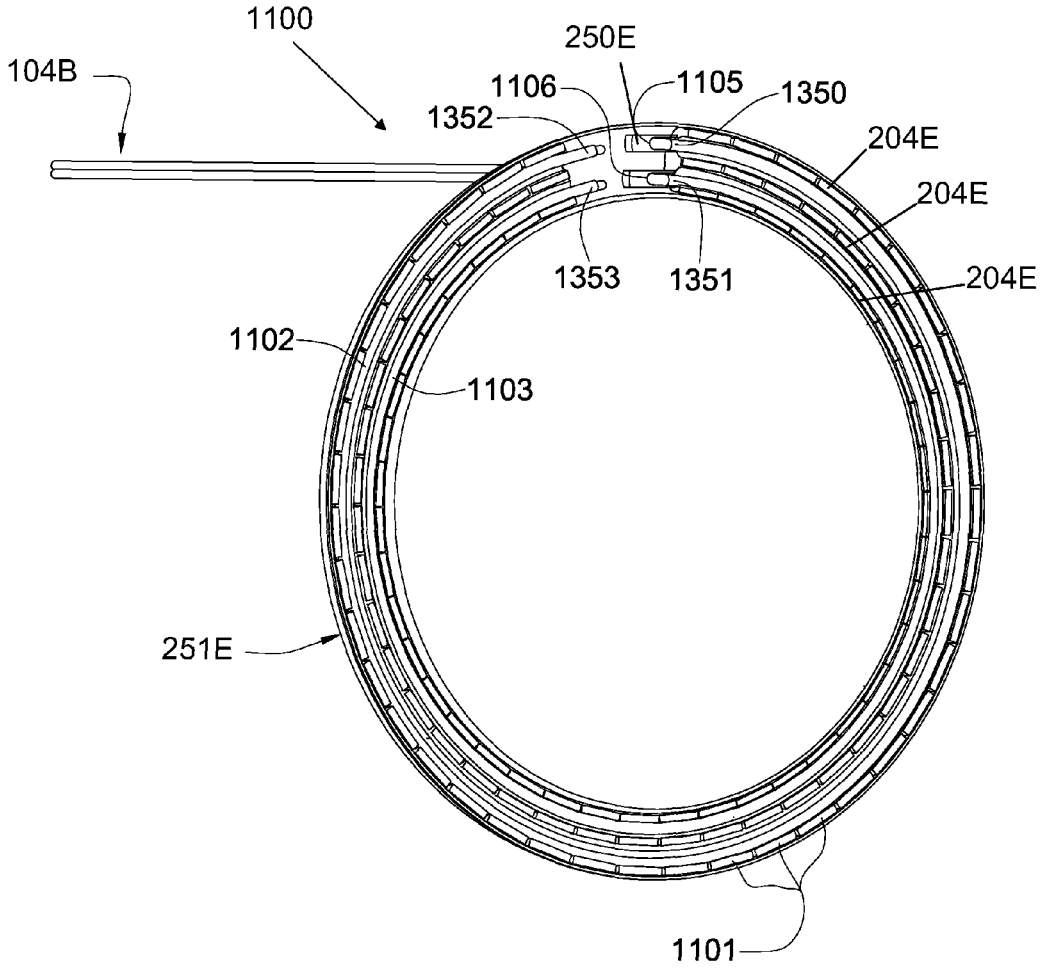
FIG. 13 is a perspective diagram of an embodiment of a pair of coils for use in a coupler.

FIG. 13 discloses an embodiment of an inductive coupler 1100 which may be used with the present invention. The coupler may comprise one or more coils 1102, 1103 comprising one or more turns disposed within troughs 250E of MCEI material 204E. The MCEI material 204E may have a composition selected from the group consisting of ferrite, nickel, iron, mu-metals, and combinations thereof. The MCEI material may have segments 1101 to prevent eddy currents or simplify manufacturing. One end 1350, 1351 of the coils 1102, 1103 may pass through holes 1105, 1106 and connect to an electrical conductor 104E, and the other end 1352, 1353 may be welded to the ring 251E as ground to complete the electrical circuit.

The individual troughs may have different permeabilities which affect the frequencies at which they resonate. The different permeabilities may be a result of forming the individual troughs with different chemical compositions. For example more iron, nickel, zinc or combinations thereof may have a higher concentration proximate either the first or second trough. The different compositions may also affect the Curie temperatures exhibited by each trough.

Figure 15:
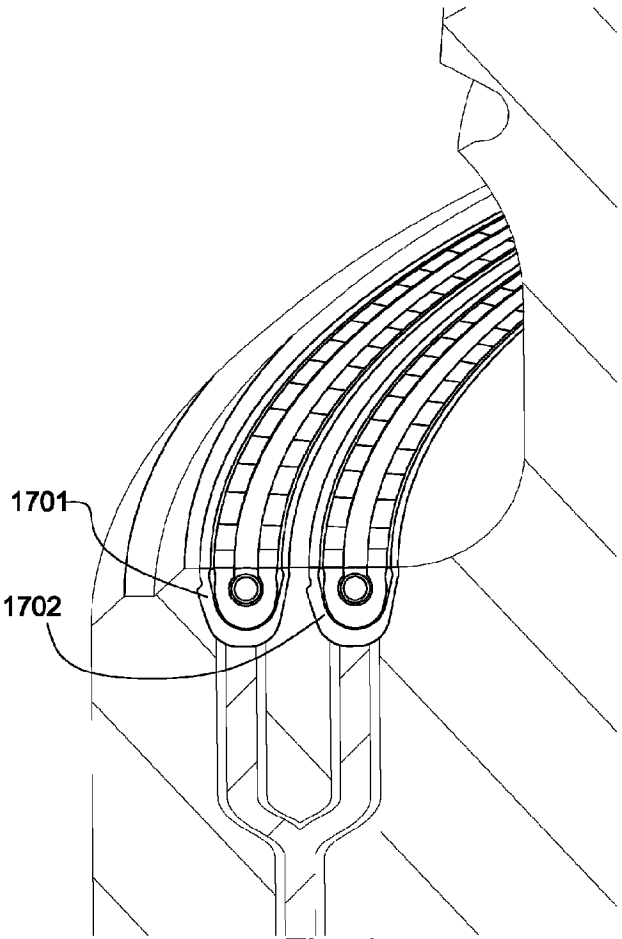
FIG. 15 is a cut away view of another embodiment of a pair of coils.
Figure 14:
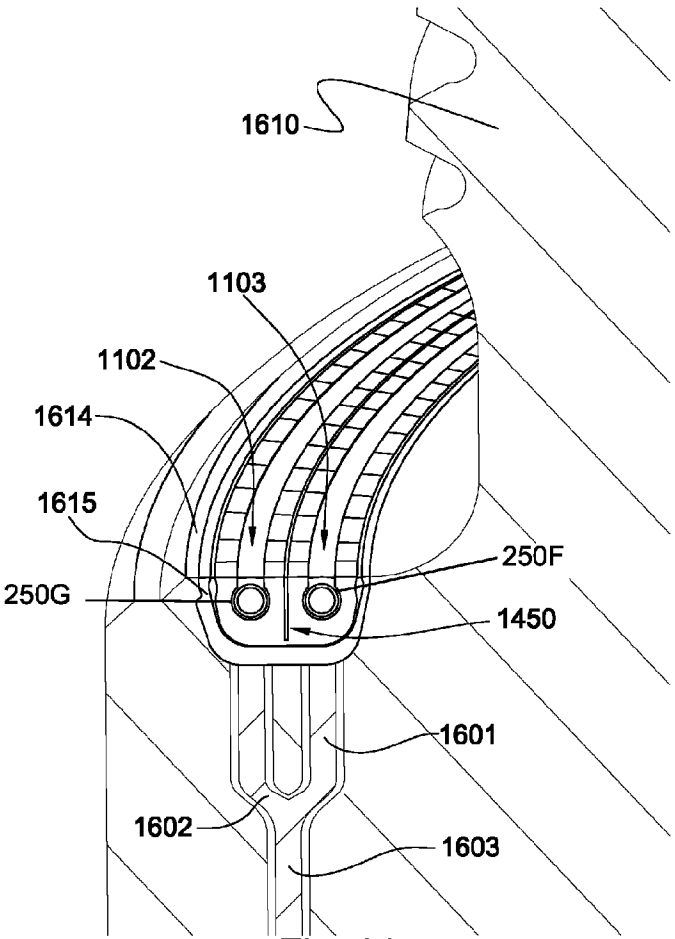
FIG. 14 is a cut away view of another embodiment of a pair of coils.

FIG. 14 and FIG. 15 are cross-sectional diagrams of the pair of coils 1102, 1103 of FIG. 13 in a shoulder 1614 of a component 1610. As seen in FIG. 14, coils 1102, 1103 may be disposed within individual troughs 250F, 250G of MCEI material 204F disposed within a single groove 1615 and an electrical conductor 1603 may be connected to the coils 1102, 1103 through branches 1602, 1601, respectively. The troughs may be separated by a magnetically insulating material 1450 to prevent interference between the magnetic fields produced. Alternatively, the coils 1102, 1103 may be in troughs of MCEI material in separate grooves 1701, 1702 as in FIG. 15.

Figure 16:
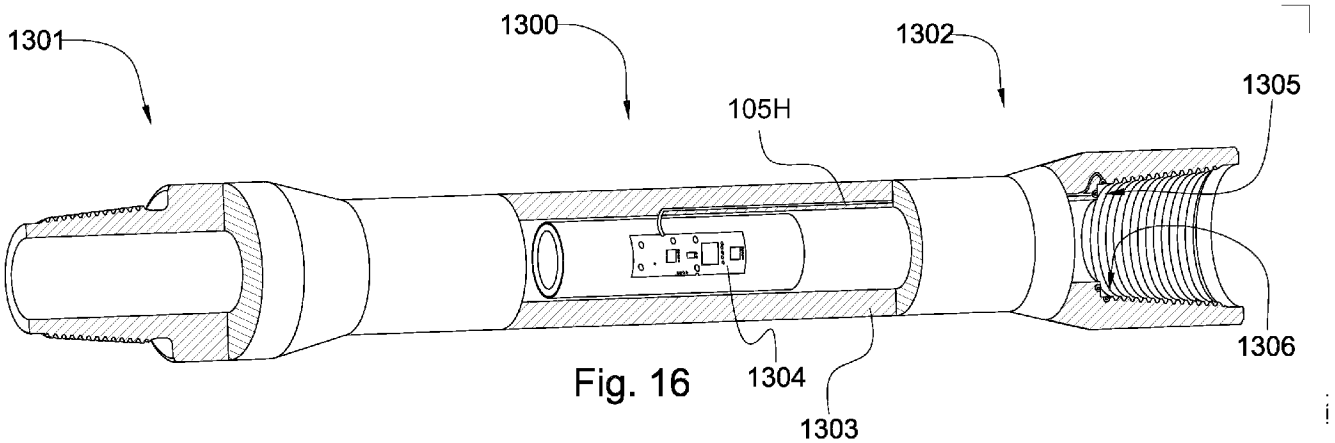
FIG. 16 is cut away view of an embodiment of electronic equipment disposed within a tool string component.
Figure 17:
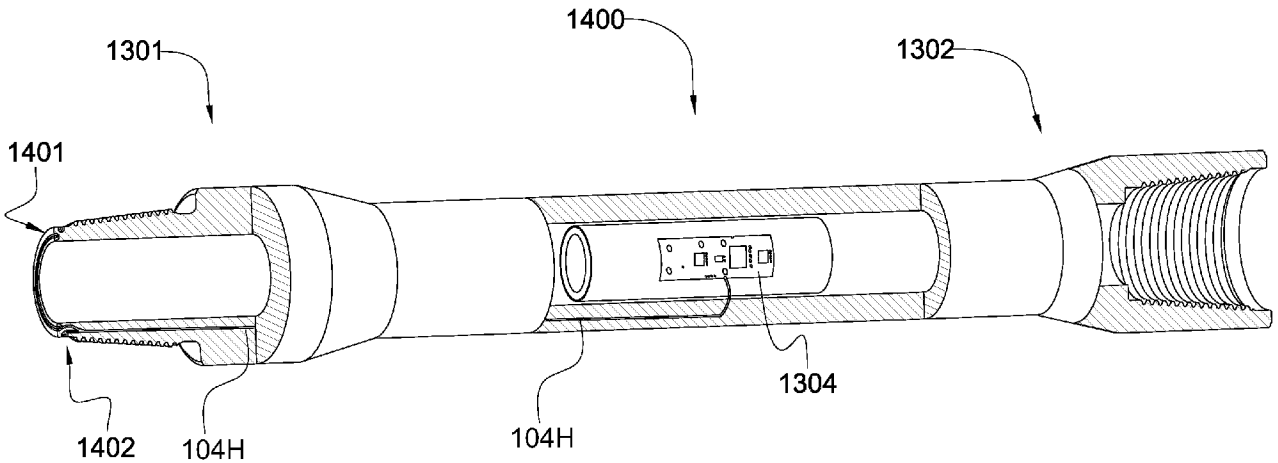
FIG. 17 is cut away view of another embodiment of electronic equipment disposed within a tool string component.

Referring to FIGS. 16 and 17 collectively, components 1300, 1400 have electronic equipment 1304. In FIG. 16 a box end 1302 has a plurality of inductive couplers 1305, 1306 and the component 1300 further includes an electrical conductor 105H in the body 1303 of the component 1300. The electrical conductor 105H connects the inductive couplers 1305, 1306 to the electronic equipment 1304. A pin end 1301 is free of signal couplers which may be advantageous in situations where the component 1300 needs to communicate in only one direction.

FIG. 17 shows a pin end 1301 having a plurality of couplers 1401, 1402 connected by an electrical conductor 104H to the electronic equipment 1304.

The electronic equipment 1304 may be inclinometers, temperature sensors, pressure sensors, or other sensors that may take readings of downhole conditions. Information gathered by the electronic equipment 1304 may be communicated to the drill string through the plurality of inductive couplers in the box end 1301 through a single electrical conductor 105. Also, power may be transmitted to the electronic equipment 1304 from a remote power source.

The electronic equipment 1304 may comprise a router, optical receivers, optical transmitters, optical converters, processors, memory, ports, modem, switches, repeaters, amplifiers, filers, converters, clocks, data compression circuitry, data rate adjustment circuitry, or combinations thereof.

Figure 18:
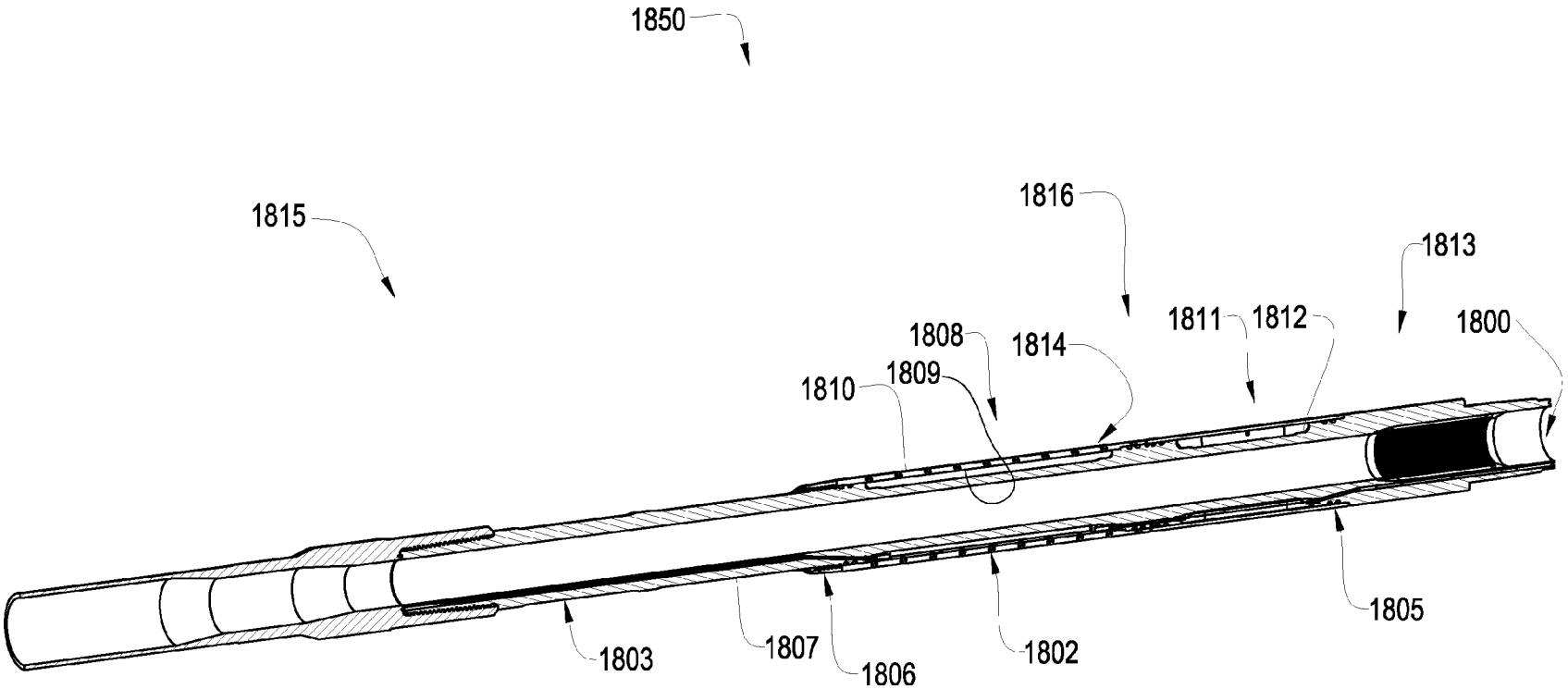
FIG. 18 is a cross-sectional diagram of an embodiment of a tool string component with a sleeve secured to its outer diameter.
Figure 19:
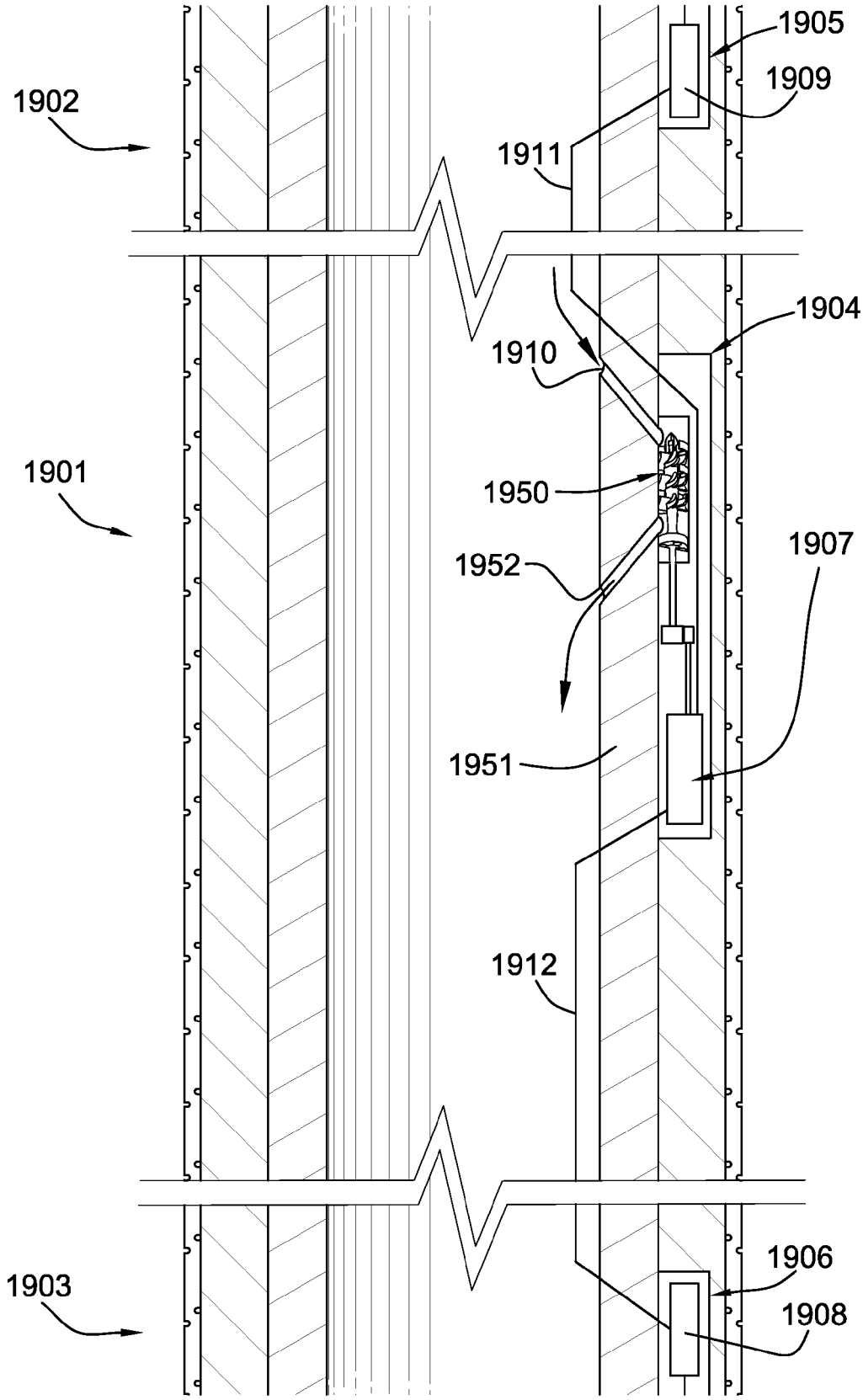
FIG. 19 is a cross-sectional diagram of an embodiment of tool string components having an electrical generator.

FIG. 18 is a cross-sectional diagram of an embodiment of downhole tool string component 1850. A compliant covering 1802 is coaxially secured at a first end 1805 and a second end 1806 to an outside diameter 1807 of the tubular body 1803. The covering 1802 may comprise at least one stress relief groove 1808 formed in an inner surface 1809 and an outer surface 1810 of the covering 1802. A closer view of the stress relief grooves 1808 is shown in FIG. 19 for clarity.

As shown there is at least one enclosure formed between the covering 1802 and the tubular body 1803. The first enclosure 1811 is partially formed by a recess 1812 in an upset region 1813 of the first end 1800 of the tubular body 1803. A second enclosure 1814 is also formed between the covering 1802 and the tubular body 1803. Electronic equipment may be disposed within the enclosures to process data or generate power to be sent to other components in the tool string.

The covering 1802 may be made of a material comprising beryllium cooper, steel, iron, metal, stainless steel, austenitic stainless steels, chromium, nickel, cooper, beryllium, aluminum, ceramics, alumina ceramic, boron, carbon, tungsten, titanium, combinations, mixtures, or alloys thereof. The compliant covering 1802 is also adapted to stretch as the tubular body 1803 stretches. The stress relief grooves' 1808 parameters may be such that the covering 1802 will flex outward a maximum of twice its width under pressure. Preferably, the compliant covering 1802 may only have a total radial expansion limit approximately equal to the covering's thickness before the covering 1802 begins to plastically deform. The tool string component 1850 as shown in FIG. 18 has a first section 1815 and a second section 1816, where the covering 1802 is attached to the second section 1816. Preferably the covering 1802 has a geometry which allows the second section 1816, with the covering 1802 attached, to have substantially the same compliancy as the first section 1815.

The tool string component 1850 preferably comprises a seal between the covering 1802 and the tubular body 1803. This seal may comprise an O-ring or a mechanical seal. Such a seal may be capable to inhibiting fluids, lubricants, rocks, or other debris from entering into the enclosures 1811 or 1814. This may prevent any electronic equipment disposed within the enclosures from being damaged.

FIG. 19 discloses three components 1901, 1902, 1903 of the tool string, each comprising a covering similar to the covering 1802 disclosed in the embodiment of FIG. 18, wherein each sleeved enclosure 1904, 1905, 1906 comprises electronic equipment 1907, 1908, 1909 which may comprise power sources, batteries, generators, circuit boards, sensors, seismic receivers, gamma ray receivers, neutron receivers, clocks, caches, optical transceiver, wireless transceivers, inclinometers, magnetometers, digital/analog converters, digital/optical converters, circuit boards, memory, strain gauges, temperature gauges, pressure gauges, actuators, and combinations thereof.

The electronic equipment 1907, 1908, 1909 may be in electrical communication with each other through electrical conductors 1911, 1912. The electrical conductors 1911, 1912 may transmit a data signal and a power signal, two data signals, or two power signals. Preferably, the electrical conductors 1911, 1912 are in communication with the couplers of the present invention and are adapted to transmit data and/or power signals.

An electric generator 1950, such as a turbine, may be disposed within one of the enclosures between the tubular body of the tool string component and the covering. In embodiments where the electronic equipment 1907 comprises a turbine, fluid may be in communication with the turbine through a bored passage 1910 in the tool string component's wall 1951. A second passage 1952 may vent fluid away from the turbine and back into the bore 1953 of the component. In other embodiments, the fluid may be vented to the outside of the tool string component by forming a passage in the covering 1802. The generated power may then be transmitted to other tool string components 1902, 1903 through the inductive couplers of the present invention. The generator may provide power to the electronic equipment disposed within the tool string component. In some embodiments of the present invention, such as in the bottom hole assembly, electronic equipment may only be disposed within a few tool string components and power transmission over the entire tool string may not be necessary. In such embodiments, the couplers of the present invention need not be optimized to reduce all attenuation since the power signals will only be transmitted through a few joints. The power generated in component 1901 may be transmitted to both the components 1902 or 1903, or it may only need to be transmitted to one or the other.

Figure 20:
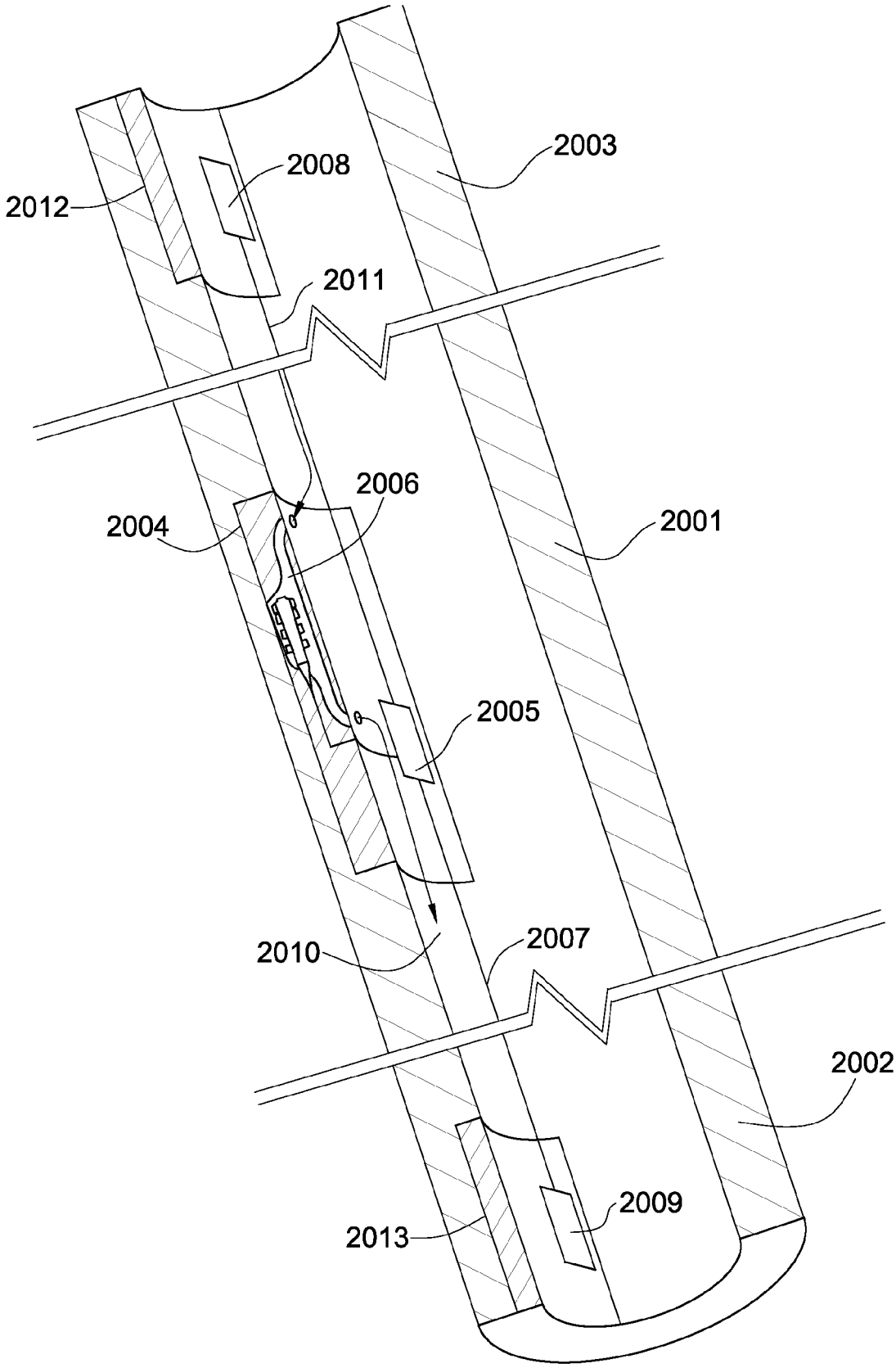
FIG. 20 is a cross-sectional diagram of another embodiment of tool string components having an electrical generator.

FIG. 20 is another embodiment of a plurality of tool string components 2001, 2002, 2003 which are connected and in electrical communication with each other through electrical conductors 2011, 2007. The tool string components may be thick walled components such as drill collars or heavy weight pipe. Each electrical conductor 2007, 2011 may transmit data and/or power signals. In this embodiment, electronic equipment 2005, 2008, 2009 is disposed within recesses 2004, 2012, 2013 in bores of the tool string components 2001, 2002, 2003.

The electric generator 1950 may also be disposed within the component 2001 and be adapted to provide power of the electronic equipment in the adjacent components 2002, 2003

Figure 21:
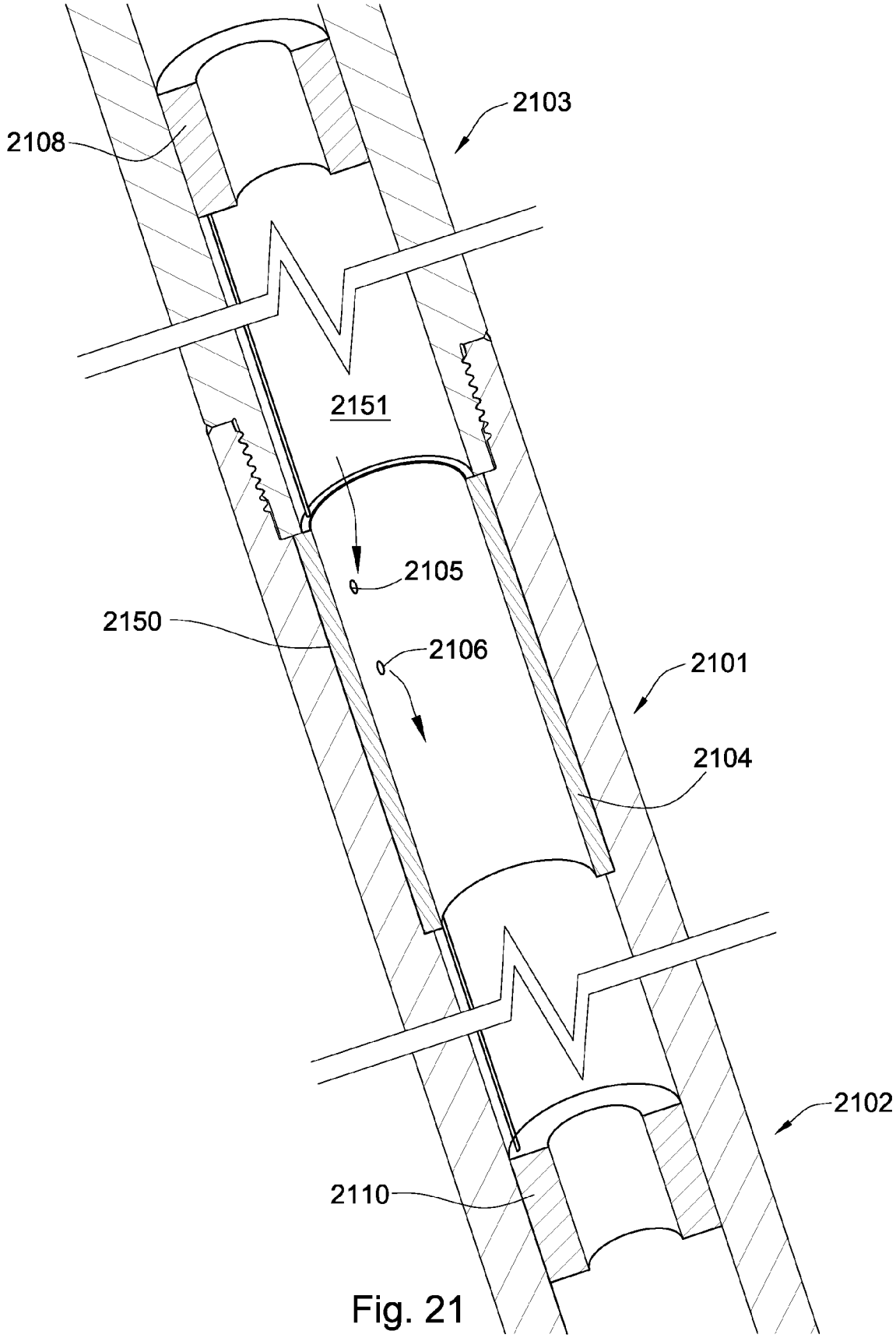
FIG. 21 is a cross-sectional diagram of another embodiment of tool string components having an electrical generator.

FIG. 21 is a cross sectional diagram of another embodiment wherein electronic equipment is disposed within a recess 2150 formed in the bore 2151 of tool string components 2101. The first tool string component 2101 comprises electronic equipment 2104 disposed within the recess 2150. Electronic equipment 2108, 2110 is also disposed within the bores of the second and third tool string components 2103, 2102. In order to insert the electronic equipment within the bore 2151, the component 2101 may be cut in two. The two pieces may be threaded to reconnection. Such a system of retaining the electronic equipment in component 2101 is disclosed in U.S. Patent Publication 20050161215, which is herein incorporated by reference for all that it discloses.

Figure 22:
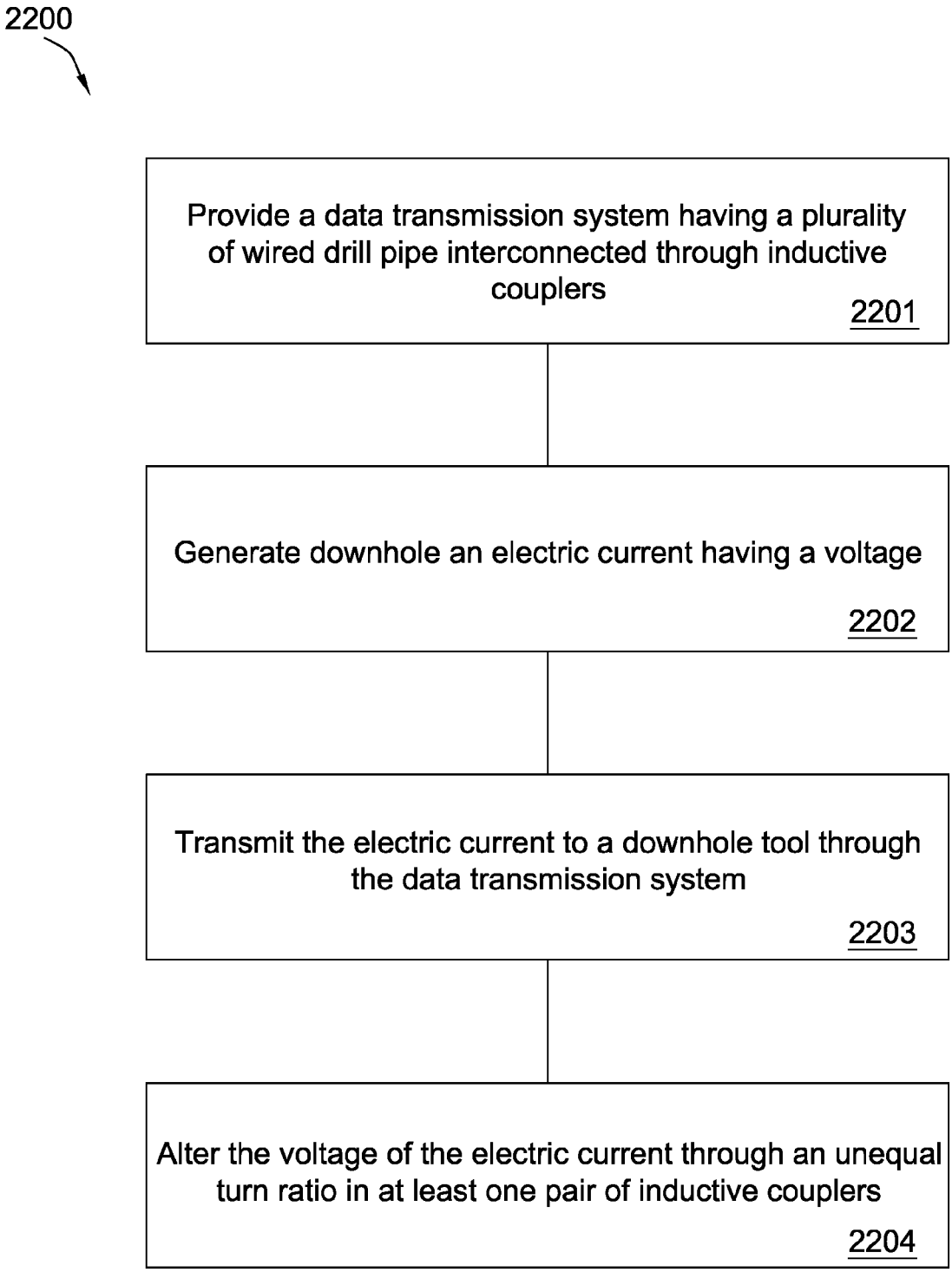
FIG. 22 is a flowchart of an embodiment of a method of transmitting power through a downhole network.

FIG. 22, discloses a method 2200 for transmitting power through a tool string. The method 2200 includes a step for providing 2201 a data transmission system having a plurality of wired drill pipe interconnected through inductive couplers. The method further includes generating 2202 downhole an electric current having a voltage and transmitting 2203 the electric current to a downhole tool through the data transmission system. The voltage of the electric current is then altered 2204 through an unequal turn ratio in at least one pair of inductive couplers. The altered electric current may be used to power electronic equipment downhole.

Whereas the present invention has been described in particular relation to the drawings attached hereto, it should be understood that other and further modifications apart from those shown or suggested herein, may be made within the scope and spirit of the present invention.

What is claimed is:

1. A system comprising:

a first tubular tool string component, said first tubular string component having a first end, said first end having a first shoulder and a first coupling means, said first shoulder having a first groove formed therein;

a second tubular string component, said second tubular string component having a second end, said second end having a second shoulder and a coupling means, said second shoulder having a second groove formed therein, and said second tubular string component being coupled to said first tubular string component through said coupling means, thereby positioning said second shoulder proximate said first shoulder;

a first inductive coil disposed within said first groove, said first inductive coil having a first electrical conductor having a first number of turns; and a second inductive coil disposed within said second groove, said second inductive coil having a second electrical conductor having a second number of turns, said second number of turns being greater than said first number of turns, and said second inductive coil being in magnetic communication with said first inductive coil a third inductive coil in electrical communication with said first inductive coil, said third inductive coil disposed proximate said first end of said first tubular string component, said third inductive coil having a third electrical conductor having a third number of turns;

a fourth inductive coil in electrical communication with said second inductive coil, said fourth inductive coil disposed proximate said second end of said second tubular string component, said fourth inductive coil having a fourth electrical conductor having a fourth number of turns, said fourth inductive coil being in magnetic communication with said third inductive coil.

2. The system of claim 1, further comprising:

a first magnetically conductive, electrically insulating material disposed within said first groove, wherein said first inductive coil is disposed within a first trough formed within said magnetically conductive, electrically insulation material; and, a second magnetically conductive, electrically insulating material disposed within said second groove, wherein said second inductive coil is disposed within a second trough formed within said second magnetically conductive, electrically insulating material.

3. The system of claim 2, further comprising a downhole power source in electrical communication with at least one of first inductive coil and said second inductive coil.

4. The system of claim 3, wherein the downhole power source includes at least one of a generator and a battery.

5. The system of claim 1, wherein said third number of turns is equal to said fourth number of turns.

6. The system of claim 5, wherein first and second inductive coils are tuned to a first resonant frequency and said third and fourth inductive coils are tuned to a second resonant frequency.

7. The system of claim 6, wherein the system is further adapted to transmit a first electrical signal from the first component to the second component at said first resonant frequency and a second electrical signal from said first component to said second component at said second resonant frequency.

8. The system of claim 7 wherein said first electrical signal is a power signal and wherein said second electrical signal is a data signal.

9. The system of claim 1, wherein said third inductive coil is disposed proximate said first shoulder and said fourth inductive coil is disposed proximate said second shoulder.

10. The system of claim 1, further comprising a third shoulder proximate said first end and a fourth shoulder proximate said second end, wherein said third inductive coil is disposed proximate said third shoulder and said fourth inductive coil is disposed proximate said fourth shoulder.

11. The system of claim 1, further comprising a bandpass filter in electrical communication with at least one of the inductive coils.

12. The system of claim 1, further comprising electronic circuitry disposed within at least one of said components and in communication with at least one said first inductive coil and said second inductive coil.

13. An drill string component comprising:

a first end;

a second end spaced distant from said first end;

a first inductive coil disposed at said first end, said first inductive coil having a first number of turns and tuned to a first resonant frequency;

a second inductive coil disposed at said first end, said second inductive coil having a second number of turns and tuned to a second resonant frequency;

a third inductive coil disposed at said second end, said third inductive coil having a third number of turns and tuned to a third resonant frequency; and an electric conductor, electrically coupling said first inductive coil, said second inductive coil, and said third inductive coil to each other.

14. The apparatus of claim 13, wherein the electrical conductor is selected from the group consisting of coaxial cable, twisted pair of wires, copper wire, and triaxial cable.

15. The apparatus of claim 13, wherein said first resonant frequency and said second resonant frequency are different.

16. The apparatus of claim 13, wherein the apparatus is adapted to transmit a first electrical signal from the third inductive coil to the first inductive coil at said first resonant frequency, and a second electrical signal from the third inductive coil to the first inductive coil at said second resonant frequency.

* * * * *

UNITED STATES PATENT AND TRADEMARK OFFICE

CERTIFICATE OF CORRECTION

PATENT NO. : 8,130,118 B2
APPLICATION NO. : 12/432231
DATED : March 6, 2012
INVENTOR(S) : Hall et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 76 days.

Signed and Sealed this
Twenty-sixth Day of June, 2012

David J. Kappos

David J. Kappos
*Director of the United States Patent and Trademark Office*